US008115162B2

(12) United States Patent
Shikai et al.

(10) Patent No.: US 8,115,162 B2
(45) Date of Patent: Feb. 14, 2012

(54) SLIDING DOOR APPARATUS AND ELEVATOR INCLUDING AN OBSTRUCTION DETECTION SYSTEM

(75) Inventors: Masahiro Shikai, Tokyo (JP); Akihide Shiratsuki, Tokyo (JP); Kazuo Takashima, Tokyo (JP); Hiroyuki Kawano, Tokyo (JP); Takaharu Ueda, Tokyo (JP); Toshio Masuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 557 days.

(21) Appl. No.: 12/294,433

(22) PCT Filed: May 29, 2007

(86) PCT No.: PCT/JP2007/060881

§ 371 (c)(1),
(2), (4) Date: Sep. 25, 2008

(87) PCT Pub. No.: WO2007/142074

PCT Pub. Date: Dec. 13, 2007

(65) Prior Publication Data

US 2009/0108987 A1 Apr. 30, 2009

(30) Foreign Application Priority Data

May 31, 2006 (WO) ..... PCT/JP2006/310851

(51) Int. Cl.
*G06M 7/00* (2006.01)

(52) U.S. Cl. ..... 250/221; 250/208.1; 187/313; 187/317

(58) Field of Classification Search ..... 250/208.1, 250/208.2, 227.11, 221; 187/316, 391, 247, 187/248, 313, 317
See application file for complete search history.

(56) References Cited

U.S. PATENT DOCUMENTS

| | | | | |
|---|---|---|---|---|
| 5,410,149 | A | 4/1995 | Winston, Jr. et al. | |
| 5,925,858 | A * | 7/1999 | Full et al. | 187/317 |
| 2003/0168288 | A1 * | 9/2003 | Deplazes et al. | 187/317 |
| 2007/0246305 | A1 * | 10/2007 | Roussel | 187/317 |

FOREIGN PATENT DOCUMENTS

| | | |
|---|---|---|
| JP | 37 9612 | 5/1962 |
| JP | S37-9612 | 5/1962 |
| JP | S53-48365 | 9/1976 |
| JP | 2 43195 | 2/1990 |
| JP | 4 358685 | 12/1992 |
| JP | H4-358685 | 12/1992 |
| JP | 6 179589 | 6/1994 |

(Continued)

OTHER PUBLICATIONS

Machine Translation of JP 2004-338846.*

(Continued)

*Primary Examiner* — Francis M Legasse, Jr.
(74) *Attorney, Agent, or Firm* — Oblon, Spivak, McClelland, Maier & Neustadt, L.L.P.

(57) ABSTRACT

In a sliding door apparatus, a first entrance is opened and closed by a first door, and a second entrance that faces the first entrance is opened and closed by a second door. Imaging means that captures images across a space between the first entrance and the second entrance is disposed beside the space. An image processing and determining portion determines presence or absence of an obstruction inside the space based on image data from the imaging means.

19 Claims, 21 Drawing Sheets

FOREIGN PATENT DOCUMENTS

| | | |
|---|---|---|
| JP | H6-179589 | 6/1994 |
| JP | 7 69571 | 3/1995 |
| JP | H7-69571 | 3/1995 |
| JP | 9 315740 | 12/1997 |
| JP | 2004 338846 | 12/2004 |
| JP | 2004-338846 | 12/2004 |
| JP | 2005 119761 | 5/2005 |
| JP | 2005-119761 | 5/2005 |

OTHER PUBLICATIONS

Office Action issued Oct. 4, 2011, in Japanese Patent Application No. 2008-520504 (with English-language Translation).

* cited by examiner

SLIDING DOOR APPARATUS AND ELEVATOR INCLUDING AN OBSTRUCTION DETECTION SYSTEM

TECHNICAL FIELD

The present invention relates to a sliding door apparatus that automatically moves a door horizontally, and to an elevator that makes use thereof.

BACKGROUND ART

In conventional sliding door apparatuses, a light emitter that has a long and continuous light-emitting surface is disposed on either a left or a right vertical frame of an entrance, and a camera that captures an image of the light-emitting surface is also disposed on a vertical frame that faces the light emitter (see Patent Document 1, for example).

Patent Document 1: Japanese Patent Laid-Open No. 2004-338846

DISCLOSURE OF THE INVENTION

Problem to be Solved by the Invention

In conventional sliding door apparatuses such as that described above, since the light emitter and the camera are disposed on the vertical frames, when portions of passengers or baggage approach the door, they may be detected as obstructions even if they are not really positioned so as to be caught in the door. For this reason, if such sliding door apparatuses are used in elevators, the doors may be reversed and opened many times during closing, reducing operating efficiency. In order to detect obstructions from a side near a landing, it is also necessary to install light emitters and cameras on the landing of every floor, increasing costs.

The present invention aims to solve the above problems and an object of the present invention is to provide a sliding door apparatus that can more reliably detect an obstruction that would actually be caught in a door, and to an elevator that makes use thereof.

Means for Solving the Problem

In order to achieve the above object, according to one aspect of the present invention, there is provided a sliding door apparatus including: a first door that opens and closes a first entrance by being slid horizontally; a second door that opens and closes a second entrance that faces the first entrance by being slid horizontally together with the first door; imaging means that is disposed beside a space between the first entrance and the second entrance, and that captures images across the space; and an image processing and determining portion that determines presence or absence of an obstruction inside the space based on image data from the imaging means.

According to another aspect of the present invention, there is provided an elevator including: a car that has a car entrance, and that is raised and lowered inside a hoistway; a car door that is disposed on the car, and that opens and closes the car entrance by being slid horizontally; a landing door that is disposed on a landing, and that opens and closes a landing entrance by being slid horizontally together with the car door; imaging means that is disposed on the car beside a space between the car entrance and the landing entrance, and that captures images across the space; and an image processing and determining portion that determines presence or absence of an obstruction inside the space based on image data from the imaging means.

BEST MODE FOR CARRYING OUT THE INVENTION

Preferred embodiments of the present invention will now be explained with reference to the drawings.

Embodiment 1

Figure 1:
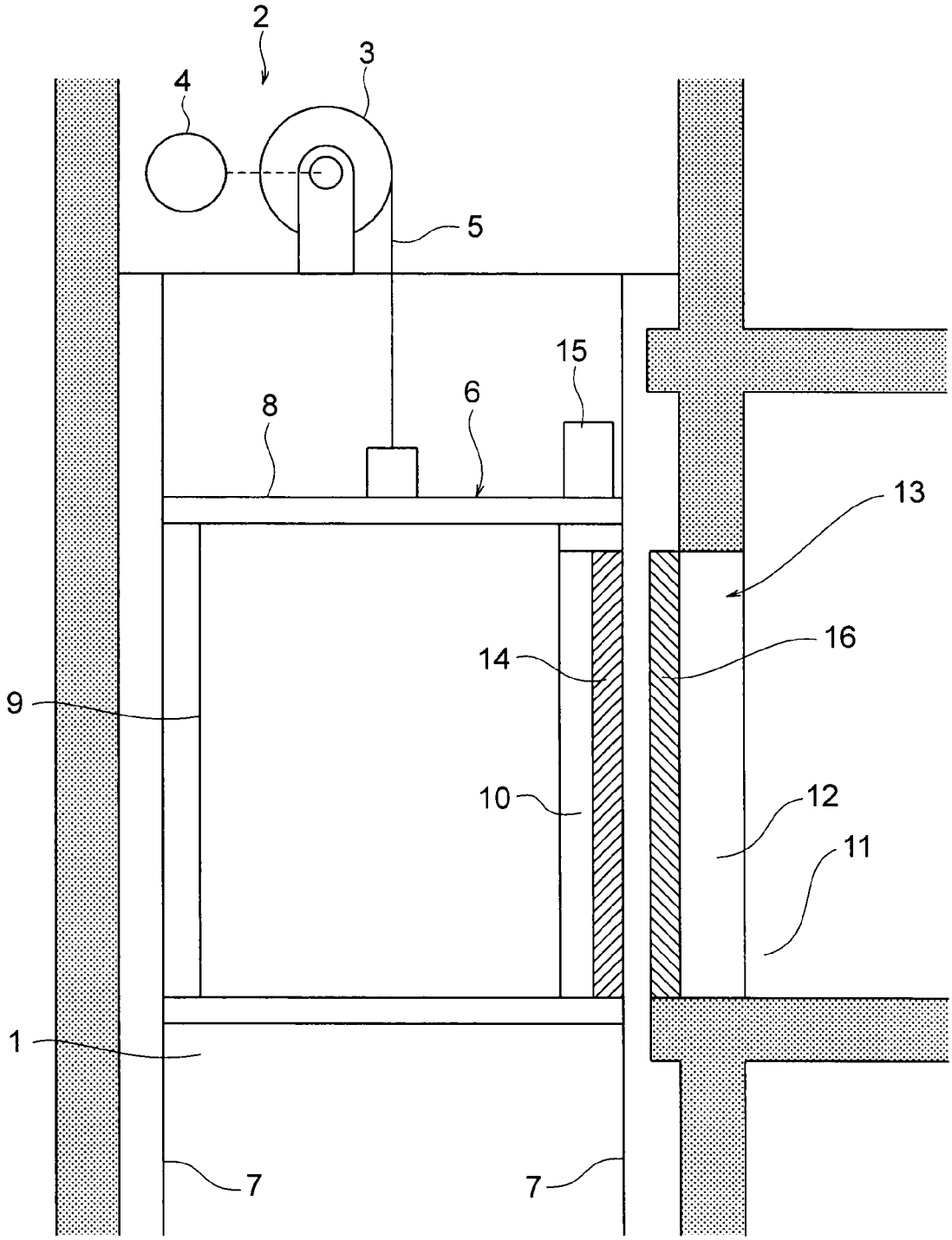
FIG. 1 is a structural diagram that shows an elevator according to Embodiment 1 of the present invention.

FIG. 1 is a structural diagram that shows an elevator according to Embodiment 1 of the present invention. In the figure, a winding apparatus 2 is installed in an upper portion of a hoistway 1. The winding apparatus 2 has: a drum 3; and a winding motor 4 that rotates the drum 3. A wire 5 that constitutes a suspending means is wound onto the drum 3.

A car 6 that constitutes a hoisted body is connected to an end portion of the wire 5. The car 6 is suspended inside the hoistway 1 by the wire 5 and is raised and lowered inside the hoistway 1 by the winding apparatus 2. A plurality of car guide rails 7 that guide raising and lowering of the car 5 are installed inside the hoistway 1.

The car 6 has: a car frame 8 to which the wire 5 is connected; and a cage 9 that is supported by the car frame 8. A car entrance 10 that constitutes a first entrance is disposed on a front surface of the cage 9. Landing entrances 12 that constitute a second entrance are disposed on landings 11. The car entrance 10 and the landing entrances 12 are opened and closed by a sliding door apparatus 13.

The sliding door apparatus 13 has: a car door apparatus 14 that opens and closes the car entrance 10; a door driving apparatus 15 that drives the car door apparatus 14; a plurality of landing door apparatuses 16 that are disposed on all of the landings 11, and that open and close the landing entrances 12. The door driving apparatus 15 is mounted onto an upper portion of the car 6. The landing door apparatuses 16 are opened and closed together with the car door apparatus 14 by engaging with the car door apparatus 14 when the car 6 arrives at the landing 11.

Figure 2:
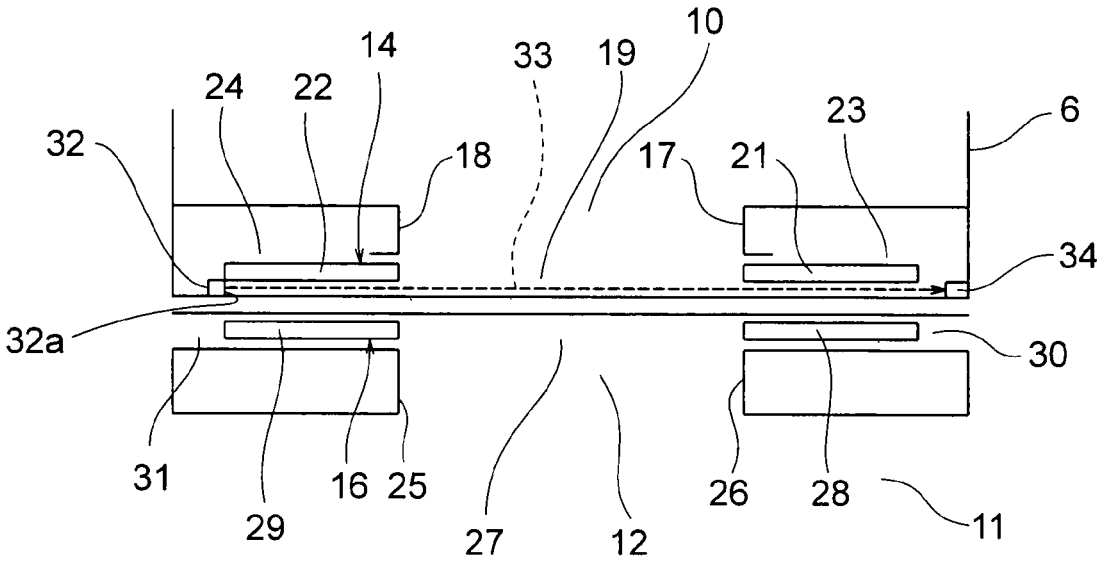
FIG. 2 is a horizontal cross section of a sliding door apparatus from FIG. 1.
Figure 3:
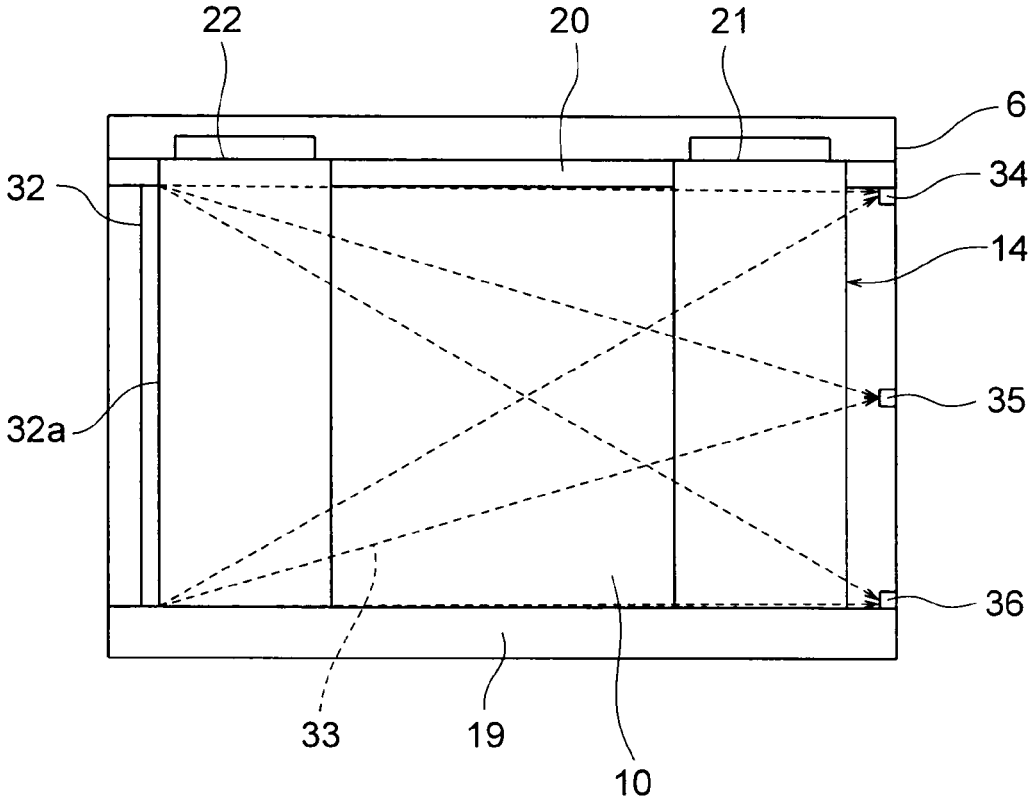
FIG. 3 is a front elevation of a car door apparatus from FIG. 2 viewed from a side near a landing.

FIG. 2 is a horizontal cross section of the sliding door apparatus 13 from FIG. 1, and FIG. 3 is a front elevation of the car door apparatus 13 from FIG. 2 viewed from a side near a landing, each showing doors in a fully open state. A pair of vertical frames 17 and 18 are disposed on two sides of the car entrance 10. Lower ends of the vertical frames 17 and 18 are linked to each other by a lower portion horizontal frame 19. Upper ends of the vertical frames 17 and 18 are linked to each other by an upper portion horizontal frame 20. The car entrance 10 is formed inside these frames 17 through 20.

The car door apparatus 14 has car doors 21 and 22 that function as a first door that opens and closes the car entrance 10. The car doors 21 and 22 act in a reverse direction to each other during opening and closing actions. The car doors 21 and 22 are housed in car door housing portions (door pocket portions) 23 and 24 when fully open.

Pairs of vertical frames 25 and 26 are disposed on two sides of the landing entrances 12. Lower ends of the vertical frames 25 and 26 are linked to each other by lower portion horizontal frames 27. Upper ends of the vertical frames 25 and 26 are linked to each other by upper portion horizontal frames (not shown). The landing entrances 12 are formed inside these frames 25 through 27.

The landing door apparatuses 16 have landing doors 28 and 29 that function as a second door that opens and closes the landing entrances 12. The landing doors 28 and 29 act in a reverse direction to each other during opening and closing actions. The landing doors 28 and 29 are housed in landing door housing portions (door pocket portions) 30 and 31 when fully open.

A light emitter 32 is disposed on the car 6 in a vicinity of the car door housing portions 24 (closer to the landings than the car door 22). The light emitter 32 aims a detecting beam 33 parallel to a closing and opening direction of the car doors 21 and 22 in a space between the car doors 21 and 22 and the landing doors 28 and 29. The light emitter 32 has a vertically long and continuous light-emitting surface 32*a*.

Imaging means that captures images of the light-emitting surface 32*a* is disposed beside a space between the car entrance 10 and the landing entrances 12.

Specifically, the imaging means has first through third cameras 34 through 36 that are disposed on the car 6 in a vicinity of the car door housing portions 23 (closer to the landings than the car door 21) so as to face the light emitter 32. The first camera 34 is disposed at a height that is approximately equal to that of an upper end portion of the car entrance 10. The second camera 35 is disposed at a height that is approximately equal to that of a vertically intermediate portion of the car entrance 10. The third camera 36 is disposed at a height that is approximately equal to that of a lower end portion of the car entrance 10. The cameras 34 through 36 are each installed so as to capture an image of the entire light-emitting surface 32*a*.

Figure 4:
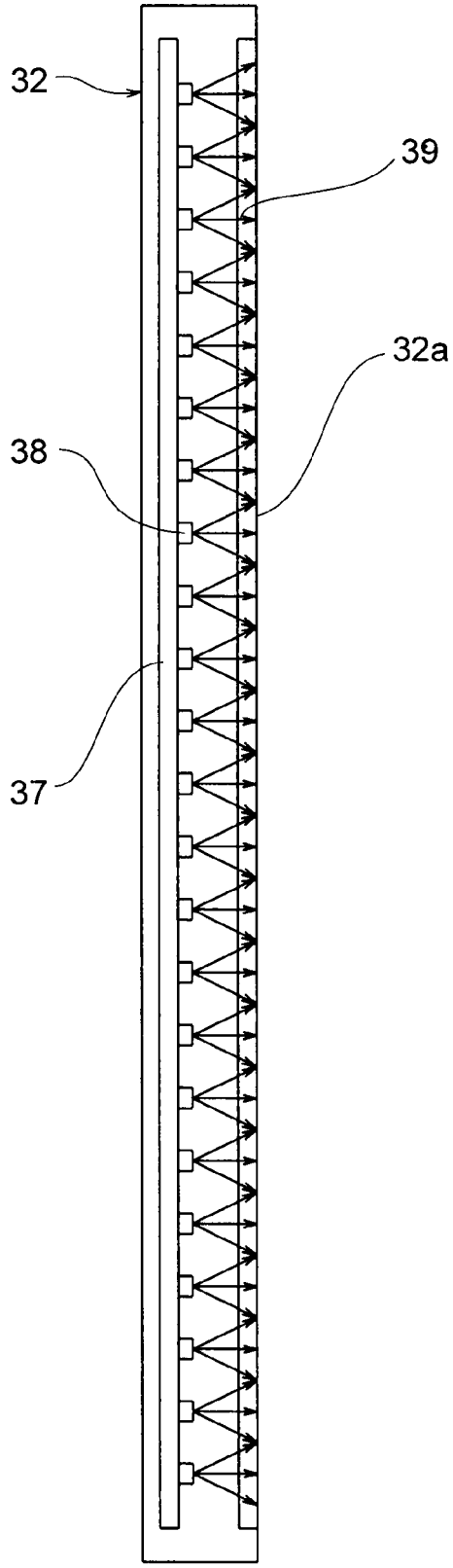
FIG. 4 is a cross section of a light emitter from FIGS. 2 and 3.

FIG. 4 is a cross section of the light emitter 32 from FIGS. 2 and 3. The light emitter 32 has: a circuit board 37; a plurality of light sources 38 that are disposed on the circuit board 37 so as to be spaced apart from each other vertically; and a translucent diffusing plate 39 that is disposed in front of the circuit board 37 so as to be opposite the light sources 38. Light-emitting diodes or semiconductor lasers, for example, can be used for the light sources 38. The light sources 38 are disposed so as to direct light over an entire region of the translucent diffusing plate 39. The translucent diffusing plate 39 scatters and emits the light from the light sources 38. The light-emitting surface 32*a* is formed by the translucent diffusing plate 39.

Figure 5:
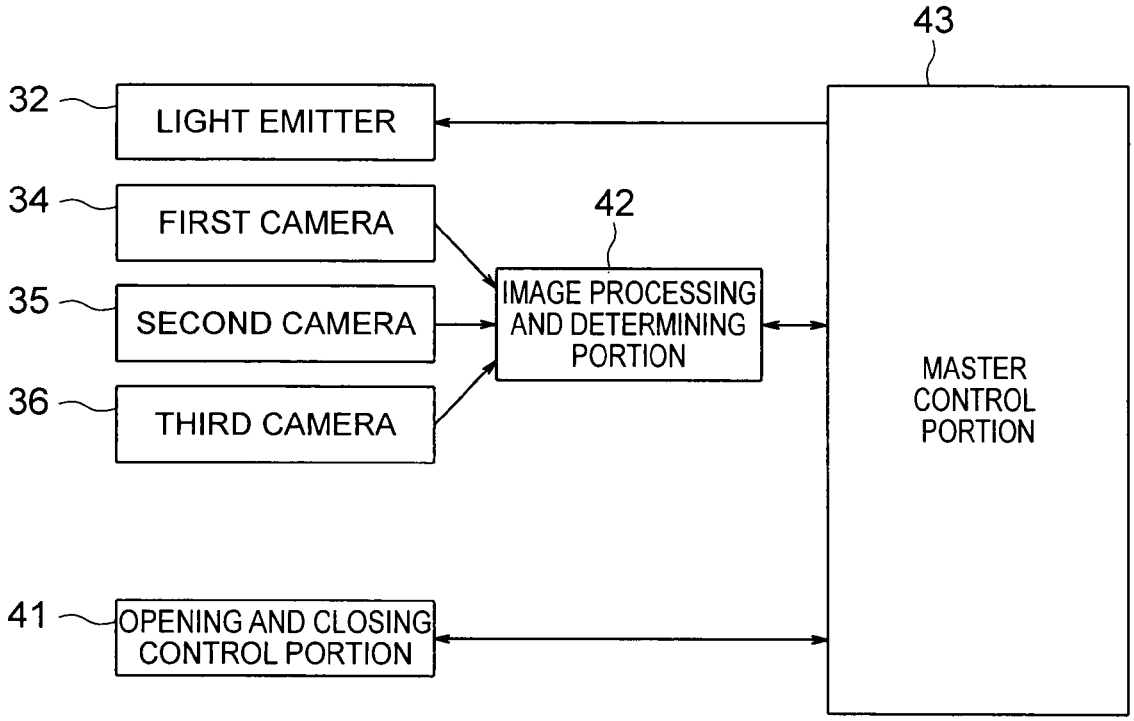
FIG. 5 is an outline block diagram that shows a control circuit of the sliding door apparatus from FIG. 1.

FIG. 5 is an outline block diagram that shows a control circuit of the sliding door apparatus 13 from FIG. 1. In the figure, the door driving apparatus 15 is controlled by an opening and closing control portion 41. Specifically, opening and closing actions of the car doors 21 and 22 and the landing doors 28 and 29 are controlled by the opening and closing control portion 41. The opening and closing control portion 41 is mounted to the car 6.

Signals from the first through third cameras 34 through 36 are sent to the image processing and determining portion 42. The image processing and determining portion 42 determines whether the detecting beam 33 from the light emitter 32 has been interrupted by an obstruction during door closing based on the signals from the cameras 34 through 36.

The light emitter 32, the opening and closing control portion 41, and the image processing and determining portion 42 are controlled by a master control portion 43. The master control portion 43 shines the detecting beam 33 from the light emitter 32 at least during a door closing action. The master control portion 43 also reverses and opens the car doors 21 and 22 and the landing doors 28 and 29 if an obstruction is detected by the image processing and determining portion 42 during the door closing action.

The opening and closing control portion 41, the image processing and determining portion 42, and the master control portion 43 are each constituted by a microcomputer. It is also possible to constitute any two of the opening and closing control portion 41, the image processing and determining portion 42, and the master control portion 43 using a shared computer. A control apparatus includes the opening and closing control portion 41, the image processing and determining portion 42, and the master control portion 43.

Next, a method for detecting obstructions using the image processing and determining portion 42 will be explained. First, image data $\alpha$ from the cameras 34 through 36 when the light emitter 32 is not switched on, and image data $\beta$ when the light emitter 32 is switched on and there is no obstruction are imported into the image processing and determining portion 42. Then, a differential image $\gamma$ is calculated by subtracting the image data $\alpha$ from the image data $\beta$. An action of this kind is repeated while executing obstruction monitoring.

When a differential process of this kind is performed, only an image of the light-emitting surface 32*a* remains in the differential image $\gamma$. Consequently, if no obstruction is present inside three triangular monitored regions that have the cameras 34 through 36 as apexes and the light-emitting surface 32*a* as base sides, a single continuous rectilinear light-emitting surface image such as that shown in FIG. 6 will remain in the differential image $\gamma$.

Figure 7:
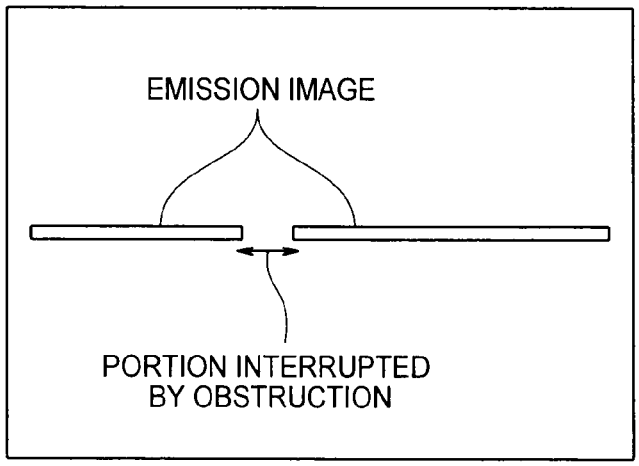
FIG. 7 is an explanatory diagram that shows a first example of a differential image that is obtained by the image processing and determining portion from FIG. 5 when an obstruction is present in a monitored region.
Figure 8:
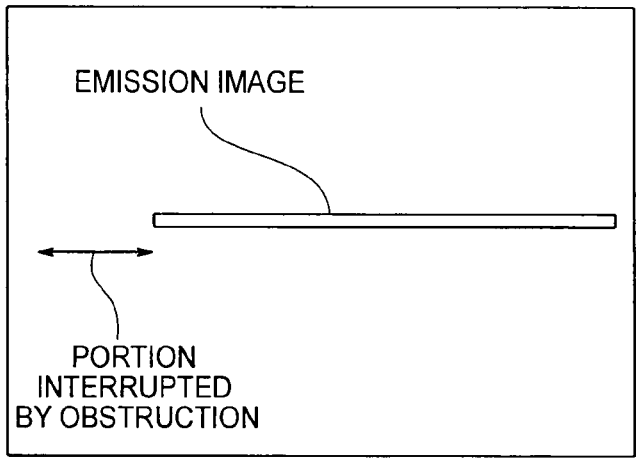
FIG. 8 is an explanatory diagram that shows a second example of a differential image that is obtained by the image processing and determining portion from FIG. 5 when an obstruction is present in a monitored region.

In contrast to that, if an obstruction is present inside the monitored regions, light-emitting surface images such as those shown in FIG. 7 or FIG. 8 will remain in the differential image $\gamma$ since a portion of the detecting beam 33 will be interrupted. Specifically, in the differential image $\gamma$ in FIG. 7, the light-emitting surface image has been divided plurally and is discontinuous. The length of the light-emitting surface image in the differential image $\gamma$ in FIG. 8 is shorter than normal. If the image processing and determining portion 42 detects that the light-emitting surface image has become discontinuous or has become shorter or that the light-emitting surface image has disappeared, then it determines that an obstruction is present and sends a signal to that effect to the master control portion 43.

Figure 9:
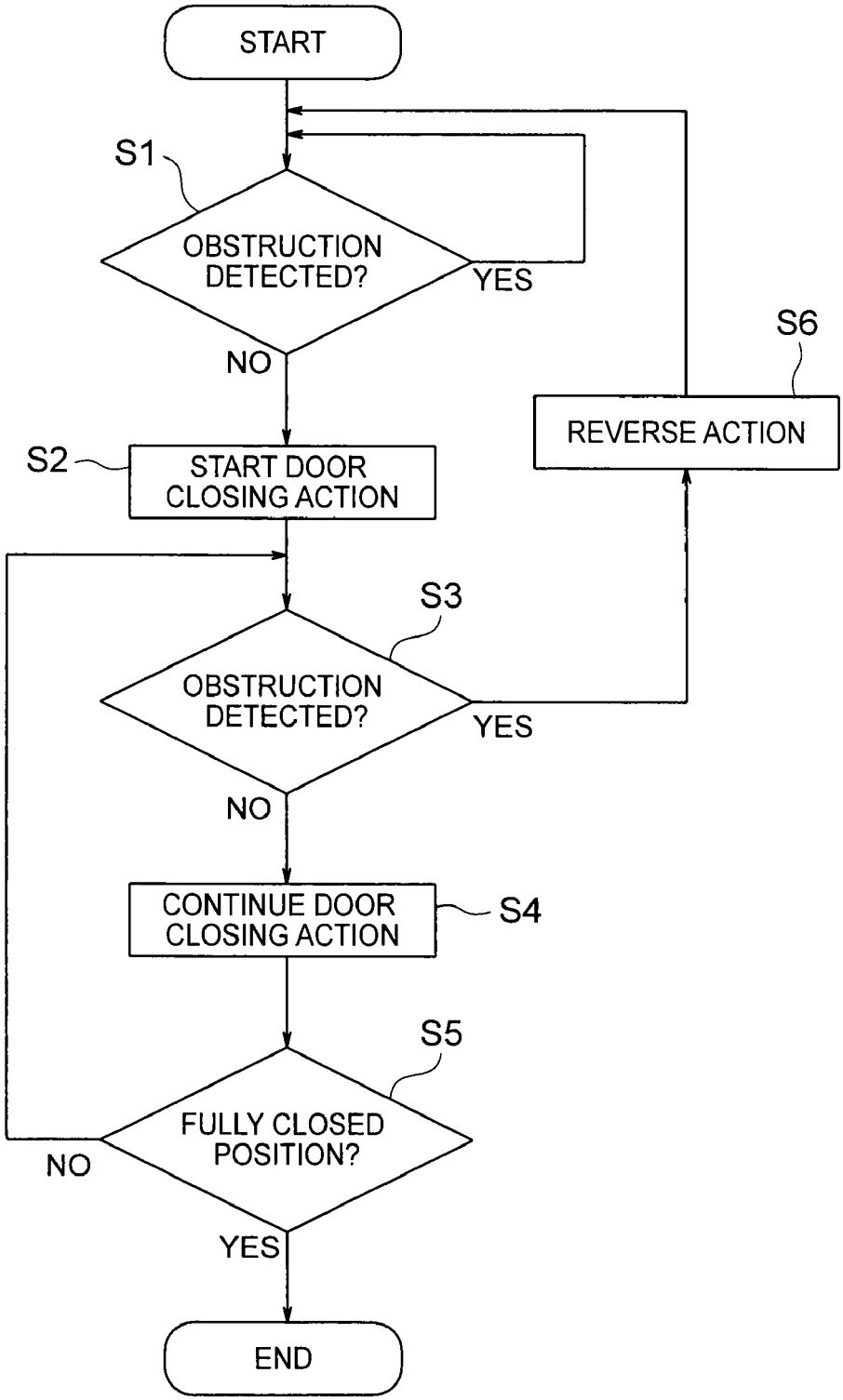
FIG. 9 is a flowchart that shows action of a master control portion from FIG. 5 during door closing.

FIG. 9 is a flowchart that shows action of the master control portion 43 from FIG. 5 during door closing. When a predetermined time interval has elapsed after door opening, the master control portion 43 checks whether an obstruction is present in the monitored regions (Step S1). If no obstruction is present, start the door closing action (Step S2). If an obstruction is present, hold until the obstruction is removed, and start the door closing action after the obstruction has been removed.

After starting the door closing action, check whether an obstruction is present in the monitored regions (Step S3), continue the door closing action if no obstruction is present (Step S4), and check whether the car doors 21 and 22 and the landing doors 28 and 29 have reached fully closed positions (Step S5). In other words, during the door closing action, the presence or absence of an obstruction is repeatedly checked for until the doors reach a fully closed state.

If an obstruction is detected during the door closing action, reverse and open the car doors 21 and 22 and the landing doors 28 and 29 (Step S6), and return to the first action. The action in FIG. 9 terminates when the doors reach a fully closed state without an obstruction being detected.

In a sliding door apparatus 13 of this kind, because the first through third cameras 34 through 36 are disposed beside the space between the car entrance 10 and the landing entrances 12 obstructions that would actually be caught in the doors 21, 22, 28, and 29 can be detected more reliably.

Because frequent occurrences of reversing action due to false detection can be prevented, operating efficiency can be improved when applied to elevators.

In addition, if applied to elevators, because the cameras 34 through 36 need only be mounted to the car 6, costs can be reduced compared to when cameras are disposed on all of the landings.

Because the light emitter 32 is disposed at a position that faces the cameras 34 through 36 across the space between the car entrance 10 and the landing entrances 12 and images of the light-emitting surface 32*a* are captured by the cameras 34 through 36, obstructions can be detected more reliably.

Because the image processing and determining portion 42 determines presence or absence of an obstruction based on a differential image between image data when the light emitter 32 is switched off and image data when the light emitter 32 is switched on, obstructions can be detected more reliably.

In addition, because the image processing and determining portion 42 determines that an obstruction is present if the image of the light-emitting surface 32*a* is discontinuous, if the length of the image of the light-emitting surface 32*a* is shortened, or if the image of the light-emitting surface 32*a* disappears, obstructions can be detected more reliably.

Because the imaging means includes three cameras 34 through 36 that are disposed at different heights, obstructions can be detected more reliably.

Embodiment 2

Figure 10:
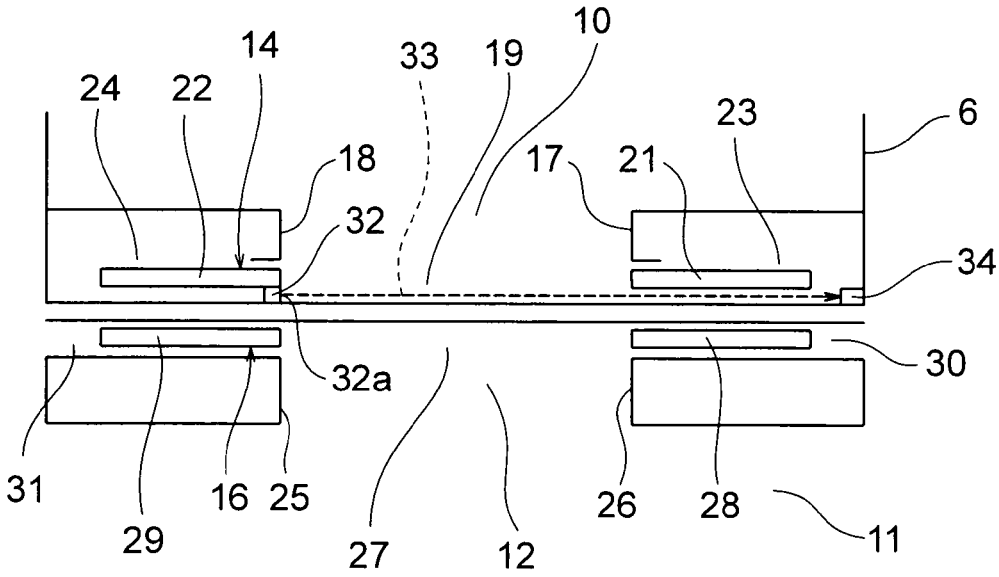
FIG. 10 is a horizontal cross section of an elevator sliding door apparatus according to Embodiment 2 of the present invention.
Figure 11:
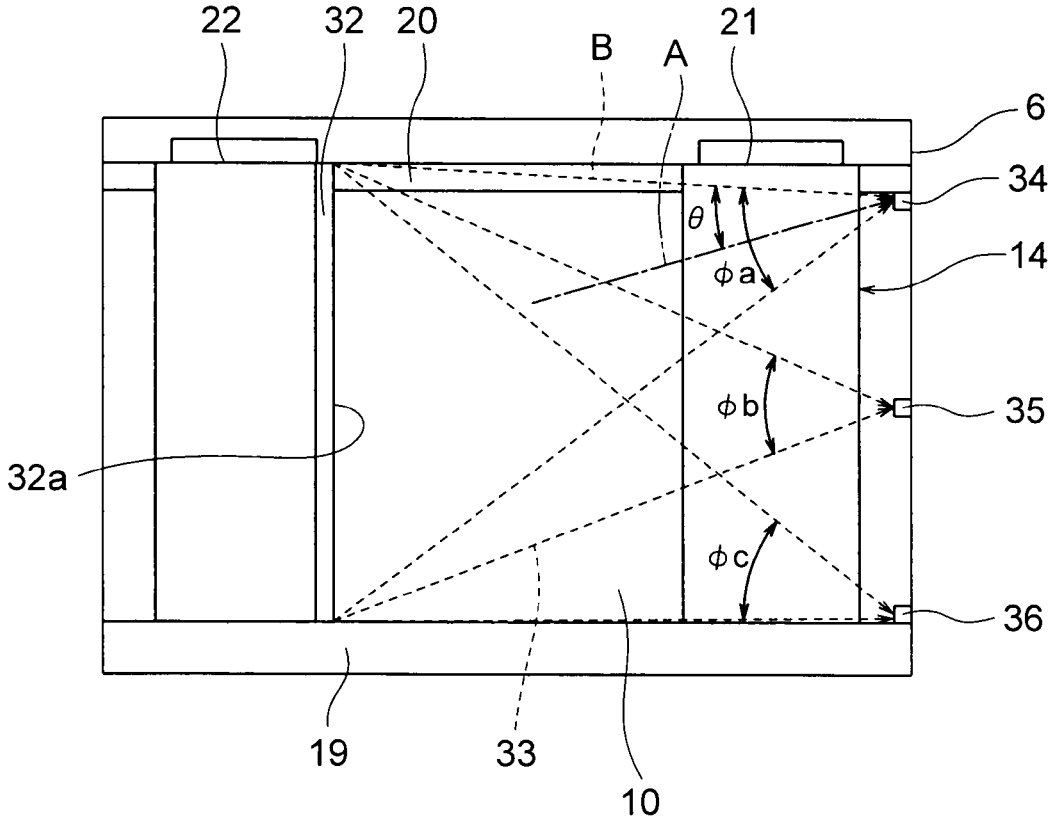
FIG. 11 is a front elevation of a car door apparatus from FIG. 10 viewed from a side near a landing.

Next, FIG. 10 is a horizontal cross section of an elevator sliding door apparatus according to Embodiment 2 of the present invention, and FIG. 11 is a front elevation of a car door apparatus from FIG. 10 viewed from a side near a landing. In the figures, a light emitter 32 is mounted to a door closing end portion of a front surface of a car door 22 (a surface that faces a landing door 29). In other words, the light emitter 32 moves together with the car door 22.

A first camera 34 is disposed at a height that is different from that of an upper end portion of a light-emitting surface 32*a*. In this case, the first camera 34 is disposed at a position that is lower than the upper end portion of the light-emitting surface 32*a*. In addition, the first camera 34 is disposed such that a straight line B that joins the upper end portion of the light-emitting surface 32*a* and the first camera 34 and an optical axis A of a lens system of the first camera 34 never become parallel.

Figure 12:
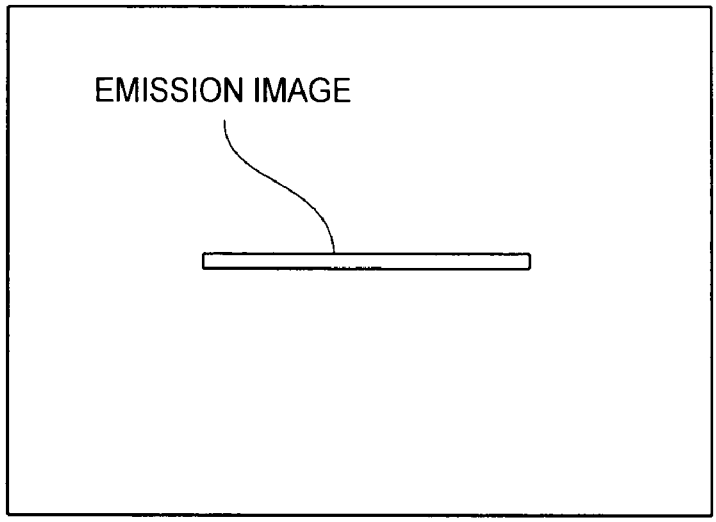
FIG. 12 is an explanatory diagram that shows a differential image that is obtained by an image processing and determining portion in the sliding door apparatus from FIG. 10 when doors are fully open.
Figure 13:
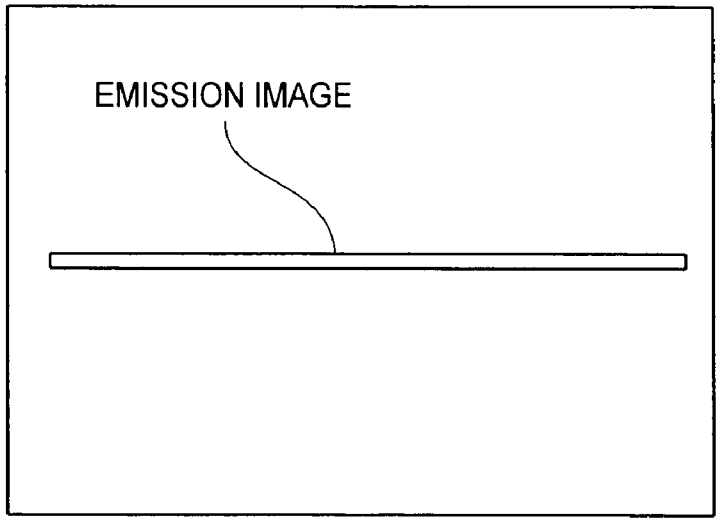
FIG. 13 is an explanatory diagram that shows a differential image that is obtained by the image processing and determining portion in the sliding door apparatus from FIG. 10 during a door-closing action.

In Embodiment 2, distances between the light emitter 32 and the cameras 34 through 36 change together with movement of the car doors 22, and perspective angles $\phi a$, $\phi b$, and $\phi c$ of the light-emitting surface 32*a* from the cameras 34 through 36 also change. Because of this, lengths of images of the light-emitting surface 32*a* that are captured by the cameras 34 through 36 change together with the movement of the car doors 22. That is, whereas a differential image $\gamma$ such as that shown in FIG. 12, for example, is obtained when the doors are fully open, a differential image $\gamma$ such as that shown in FIG. 13, for example, is obtained as the door closing action progresses, since the light-emitting surface 32*a* approaches the cameras 34 through 36.

Thus, when the light emitter 32 is mounted to the car doors 22, it is necessary to find lengths of the light-emitting surface image that constitute comparative references that correspond to the position of the car doors 22 because the length of the light-emitting surface image will change due to the door closing action of the car doors 22 even if an obstruction is not present.

Figure 14:
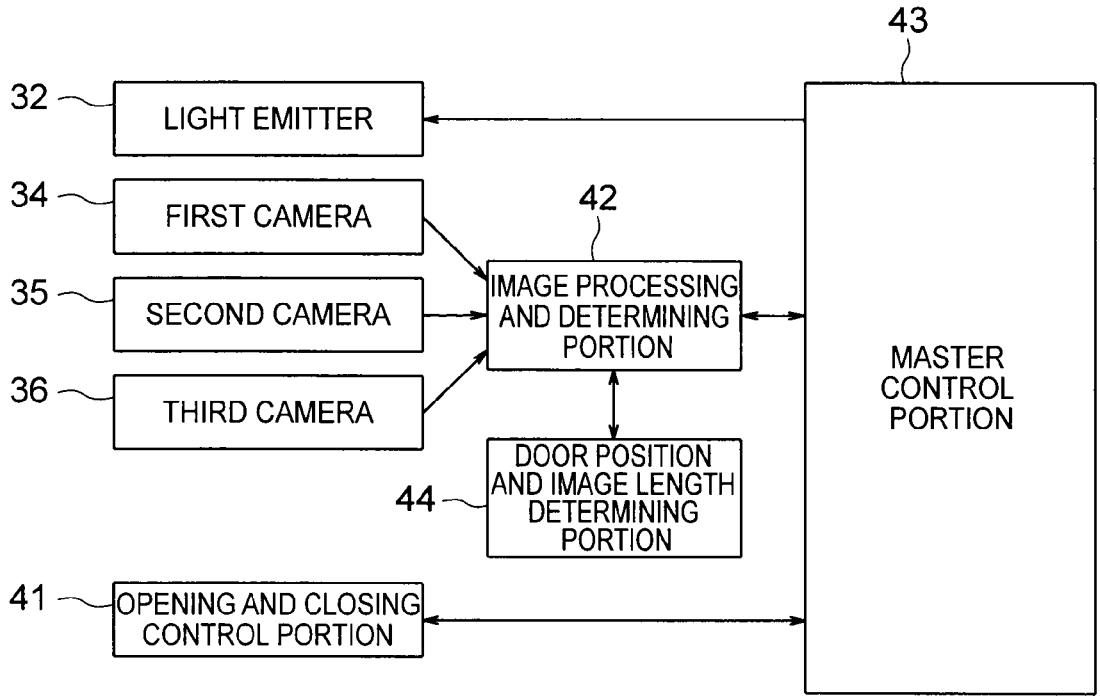
FIG. 14 is an outline block diagram that shows a control circuit of the sliding door apparatus from FIG. 10.

FIG. 14 is an outline block diagram that shows a control circuit of the sliding door apparatus from FIG. 10. A door position and image length determining portion 44 determines the position of the car doors 22 based on the data of the differential image $\gamma$ that has been obtained from an image processing and determining portion 42 and also finds a reference length for the light-emitting surface image that corresponds to the position of the car doors 22. A control apparatus includes an opening and closing control portion 41, the image processing and determining portion 42, a master control portion 43, and the door position and image length determining portion 44.

Now, in FIG. 11, an angle $\theta$ that is formed by the straight line B with respect to the optical axis A changes together with the movement of the car doors 22. Because of this, the position of the upper end portion of the image of the light-emitting surface 32*a* captured by the cameras 34 changes together with the movement of the car doors 22. Consequently, the position of the upper end portion of the light-emitting surface image of the differential image $\gamma$ that is obtained from the image data from the cameras 34 is uniquely dependent upon the position of the car doors 22.

The door position and image length determining portion 44 determines the position of the car doors 22 making use of this principle, and sends information concerning the reference length of the light-emitting surface image that corresponds to the position of the car doors 22 to the image processing and determining portion 42. Based on the reference length of the light-emitting surface image, the image processing and determining portion 42 determines the presence or absence of an obstruction in a similar manner to that of Embodiment 1. The door position and image length determining portion 44 can be constituted by a microcomputer that is shared with or independent from the image processing and determining portion 42. The rest of the configuration is similar to that of Embodiment 1.

According to a sliding door apparatus 13 of this kind, because the light emitter 32 is mounted to the car doors 22, installation space for the light emitter 32 can be reduced.

Because distances between the light emitter 32 and the cameras 34 through 36 can be shortened, detecting precision can be improved.

In addition, because the light emitter 32 and a camera 34 are disposed in such a way that the position of images of the upper end portion of the light-emitting surface 32*a* captured by the camera 34 changes together with the movement of the car doors 22, and the position of the car doors 22 and a reference length for the light-emitting surface image that corresponds to that position are found based on image data of the light-emitting surface 32*a* obtained from the camera 34, changes in the distances between the light emitter 32 and the cameras 34 through 36 due to the movement of the car doors 22 can be compensated for without having to add a door position measuring apparatus.

Moreover, visible light may also be used for the detecting beam 33 that is emitted from the light emitter 32. In that case, passengers can visually recognize the light-emitting surface 32*a*, and action of the doors 21, 22, 28, and 29 can be visually indicated to the passengers by linking timing of light emission to the action of the doors 21, 22, 28, and 29. For example, the passengers can be informed more intelligibly of the door closing action if light is not emitted while the doors are opening or while the doors are being held open, and light is emitted as the doors start to close and during the door closing action.

Embodiment 3

Figure 15:
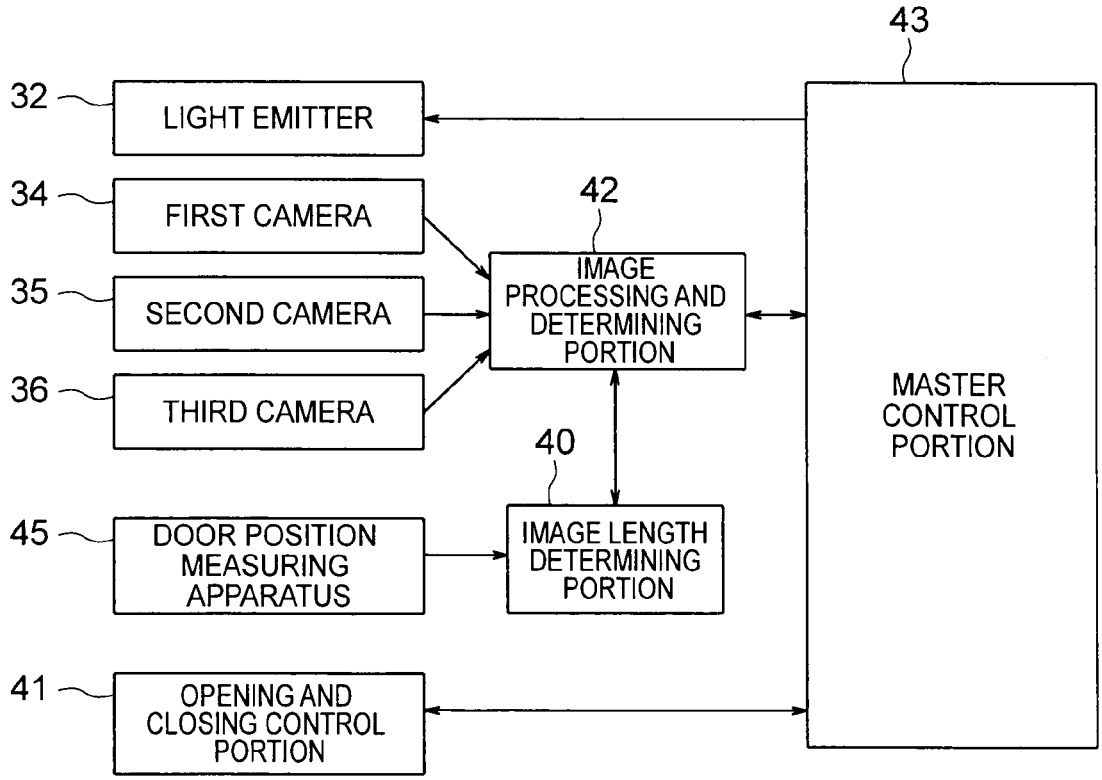
FIG. 15 is an outline block diagram that shows a control circuit of an elevator sliding door apparatus according to Embodiment 3 of the present invention.

Next, FIG. 15 is an outline block diagram that shows a control circuit of an elevator sliding door apparatus according to Embodiment 3 of the present invention. In the figure, a door position measuring apparatus 45 is disposed on a drive portion of car doors 21 and 22, and outputs a signal that corresponds to the position of the car doors 21 and 22. An encoder that is mounted to a motor of a door driving apparatus 15 can be used for the door position measuring apparatus 45, for example. An image length determining portion 40 sends information concerning a reference length of the light-emitting surface image that corresponds to the position of the car doors 21 and 22 to an image processing and determining portion 42 based on information from the door position measuring apparatus 45. A control apparatus includes an opening and closing control portion 41, the image processing and determining portion 42, a master control portion 43, and the image length determining portion 40. The rest of the configuration is similar to that of Embodiment 2.

By using a door position measuring apparatus 45 in this manner, the control circuit can be simplified, and adjustment of the mounted positions of the cameras 34 through 36 and the light emitter 32 can also be facilitated.

Embodiment 4

Figure 16:
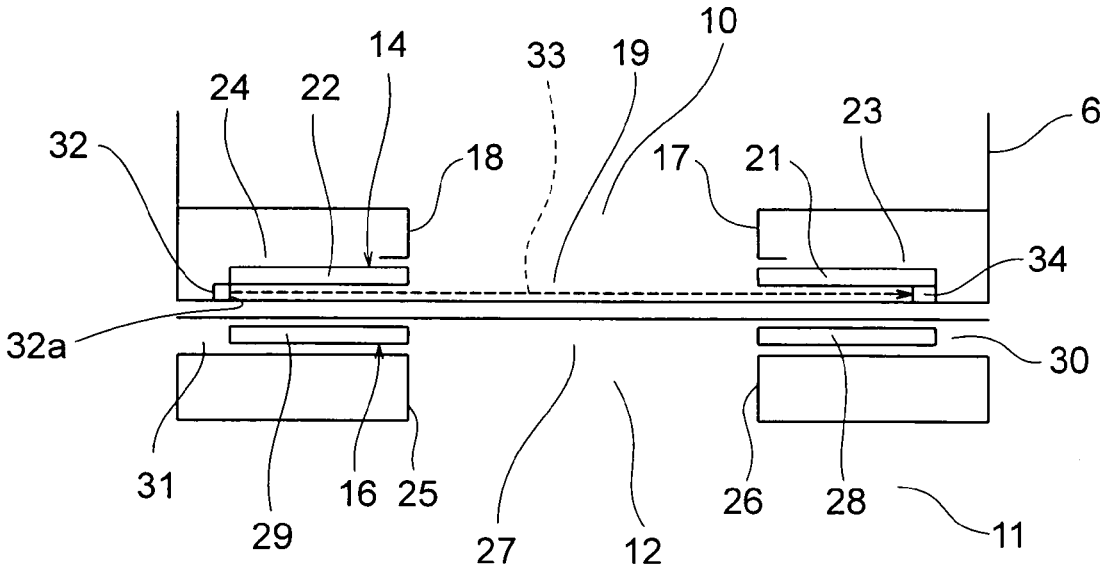
FIG. 16 is a horizontal cross section of an elevator sliding door apparatus according to Embodiment 4 of the present invention.
Figure 17:
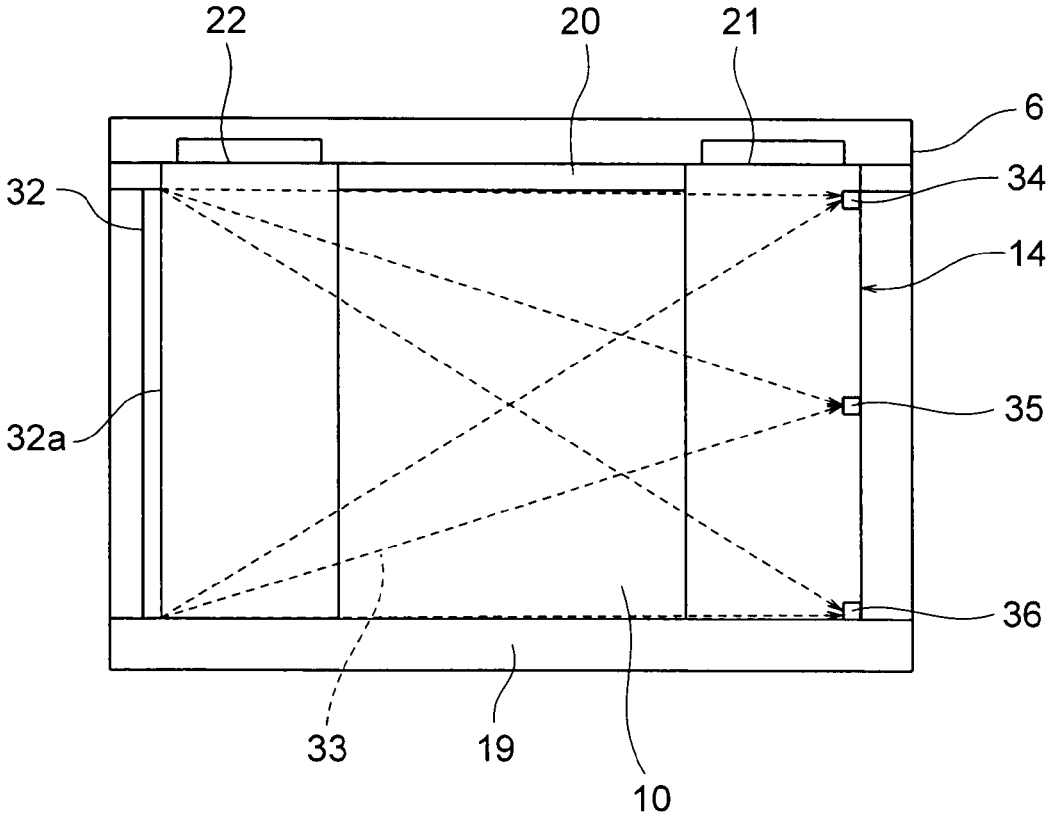
FIG. 17 is a front elevation of a car door apparatus from FIG. 16 viewed from a side near a landing.

Next, FIG. 16 is a horizontal cross section of an elevator sliding door apparatus according to Embodiment 4 of the present invention, and FIG. 17 is a front elevation of a car door apparatus from FIG. 16 viewed from a side near a landing. In this example, cameras 34 through 36 are mounted to a car door 21 instead of a light emitter 32.

Similar effects to those in Embodiment 3 above can also be achieved if the cameras 34 through 36 are mounted to the car door 21 in this manner.

Embodiment 5

Figure 18:
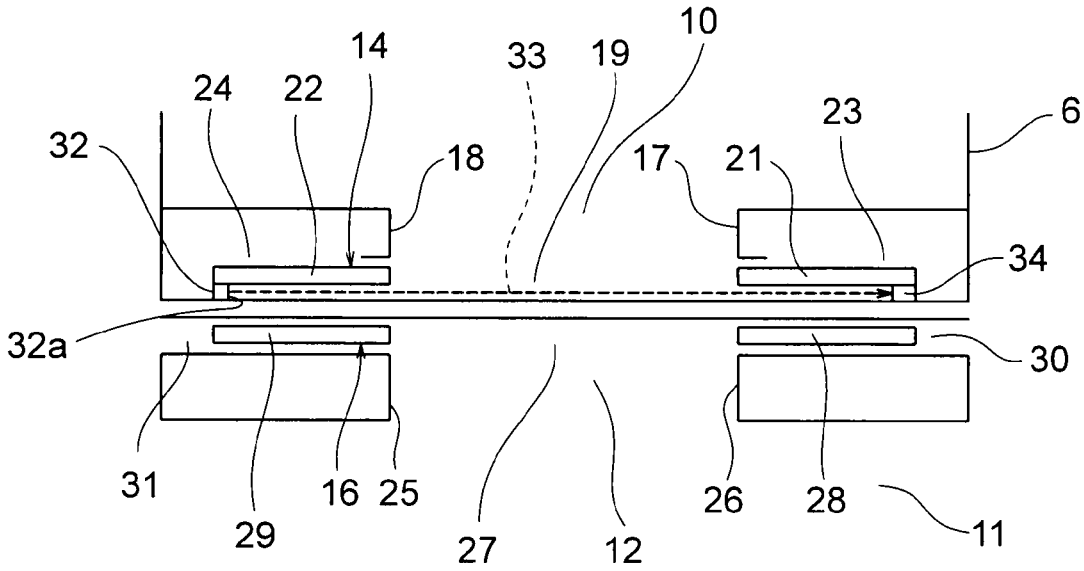
FIG. 18 is a horizontal cross section of an elevator sliding door apparatus according to Embodiment 5 of the present invention.
Figure 19:
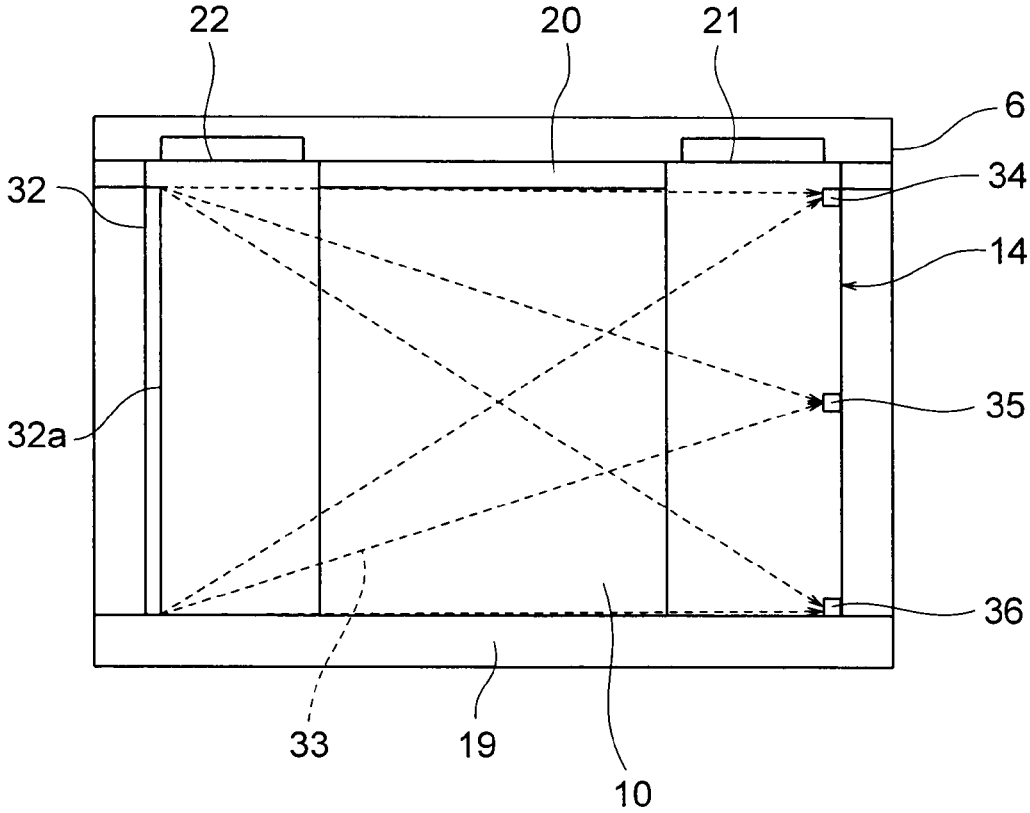
FIG. 19 is a front elevation of a car door apparatus from FIG. 18 viewed from a side near a landing.

Next, FIG. 18 is a horizontal cross section of an elevator sliding door apparatus according to Embodiment 5 of the present invention, and FIG. 19 is a front elevation of a car door apparatus from FIG. 18 viewed from a side near a landing. In this example, a light emitter 32 is mounted to a car door 22, and cameras 34 through 36 are mounted to a car door 21.

It is also possible to mount the light emitter 32 and the cameras 34 through 36 to the car doors 21 and 22 in this manner, and using this kind of configuration, obstructions that would actually be caught in the doors 21, 22, 28, and 29 can also be detected more reliably.

Embodiment 6

Figure 20:
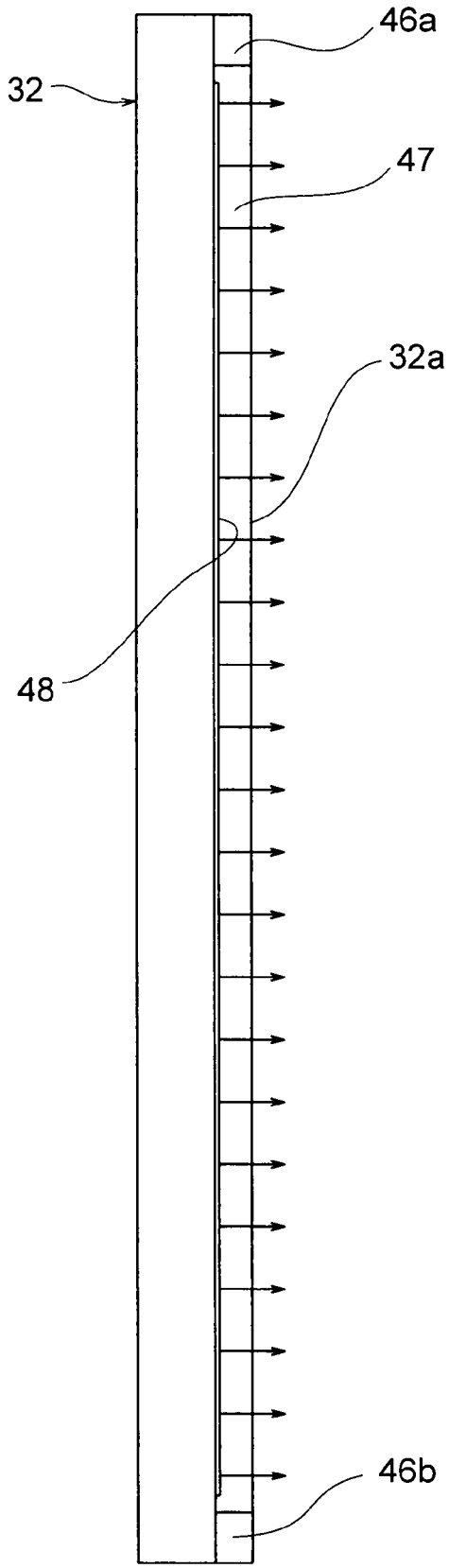
FIG. 20 is a cross section of a light emitter of a sliding door apparatus according to Embodiment 6 of the present invention.

Next, FIG. 20 is a cross section of a light emitter of a sliding door apparatus according to Embodiment 6 of the present invention. An upper portion light source 46*a* that shines light downward is fixed to an upper end portion of a light emitter 32. A lower portion light source 46*b* that shines light upward is also fixed to a lower end portion of the light emitter 32. A transparent light-conducting body 47 that conducts light longitudinally (vertically) is disposed between the upper portion light source 46*a* and the lower portion light source 46*b*. A light-emitting surface 32*a* is formed on a front surface of the transparent light-conducting body 47. A diffusing surface 48 that diffuses light is joined together with a surface of the transparent light-conducting body 47 that faces the light-emitting surface 32*a* (a back surface).

Light that has entered the transparent light-conducting body 47 from the light sources 46*a* and 46*b* is propagated through the transparent light-conducting body 47 while being diffused by the diffusing surface 48. Then, the light that has been scattered by the diffusing surface 48 is emitted from the light-emitting surface 32*a* as a detecting beam 33. The rest of the configuration is similar to that of Embodiment 1.

By using a light emitter 32 of this kind, the number of light sources 46*a* and 46*b* can be reduced, enabling power to be saved and cost reductions to be achieved.

Moreover, the diffusing surface 48 may also be formed integrally on the transparent light-conducting body 47 by machining the surface of the transparent light-conducting body 47 that faces the light-emitting surface 32*a*.

Embodiment 7

Figure 21:
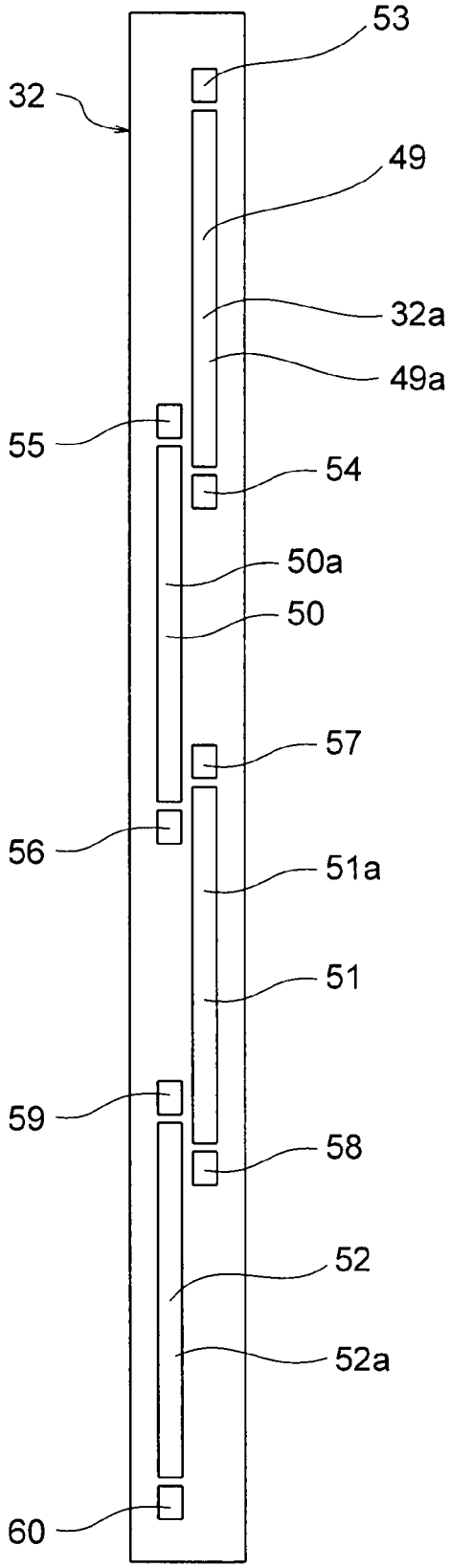
FIG. 21 is a front elevation that shows a light emitter of a sliding door apparatus according to Embodiment 7 of the present invention.

Next, FIG. 21 is a front elevation that shows a light emitter of a sliding door apparatus according to Embodiment 7 of the present invention. First through fourth transparent light-conducting bodies 49 through 52 are disposed side by side sequentially from an upper portion of a light emitter 32. The light-emitting surfaces 32*a* is thereby divided into a plurality of (four) light-emitting surfaces 49*a*, 50*a*, 51*a*, and 52*a*. The first through fourth transparent light-conducting bodies 49 through 52 are also disposed so as to be offset alternately in a width direction of the light emitter 32. In addition, vertically adjacent transparent light-conducting bodies 49 through 52 are disposed to overlap partially in a vertical direction.

A first upper portion light source 53 is disposed at an upper end portion of the first transparent light-conducting body 49. A first lower portion light source 54 is disposed at a lower end portion of the first transparent light-conducting body 49. A second upper portion light source 55 is disposed at an upper end portion of the second transparent light-conducting body 50. A second lower portion light source 56 is disposed at a lower end portion of the second transparent light-conducting body 50. A third upper portion light source 57 is disposed at an upper end portion of the third transparent light-conducting body 51. A third lower portion light source 58 is disposed at a lower end portion of the third transparent light-conducting body 51. A fourth upper portion light source 59 is disposed at an upper end portion of the fourth transparent light-conducting body 52. A fourth lower portion light source 60 is disposed at a lower end portion of the fourth transparent light-conducting body 52. Diffusing surfaces 48 (see FIG. 20) are joined with surfaces that face front surfaces (the light-emitting surfaces 49*a*, 50*a*, 51*a*, and 52*a*) of the respective transparent light-conducting body 49 through 52. The rest of the configuration is similar to that of Embodiment 1.

By using a plurality of transparent light-conducting body 49 through 52, and disposing light sources 53 through 60 at two end portions of the respective transparent light-conducting bodies 49 through 52 in this manner, intensity of the detecting beams 33 that are emitted from the respective transparent light-conducting bodies 49 through 52 can be maintained sufficiently. Light emitters 32 that have different lengths can also be prepared easily, simply by modifying the amount of vertical overlap between the transparent light-conducting bodies 49 through 52.

Moreover, the light emitter 32 is not limited to the above examples, and may also be a linear light source that uses a fluorescent lamp or an electroluminescent light source, for example.

Embodiment 8

Figure 22:
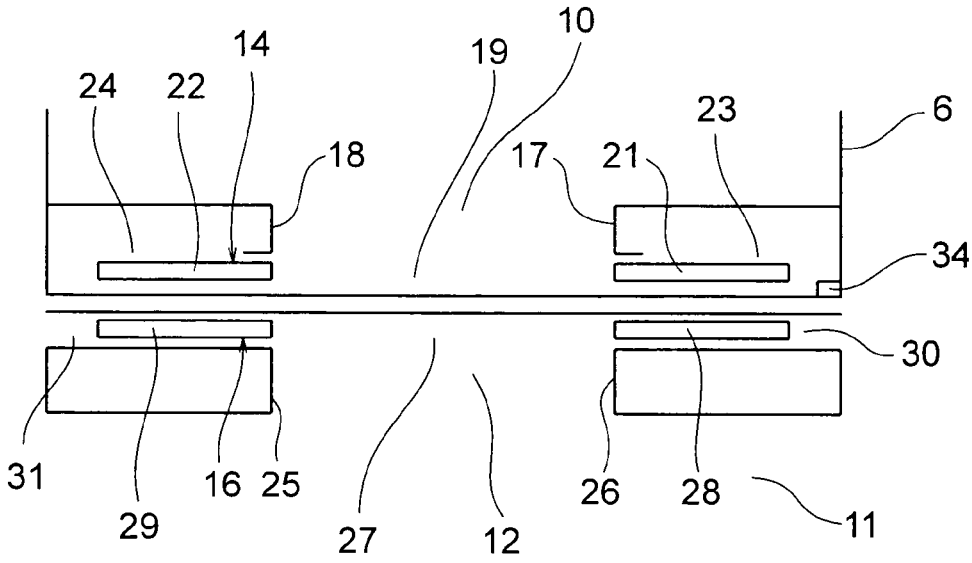
FIG. 22 is a horizontal cross section of an elevator sliding door apparatus according to Embodiment 8 of the present invention.
Figure 23:
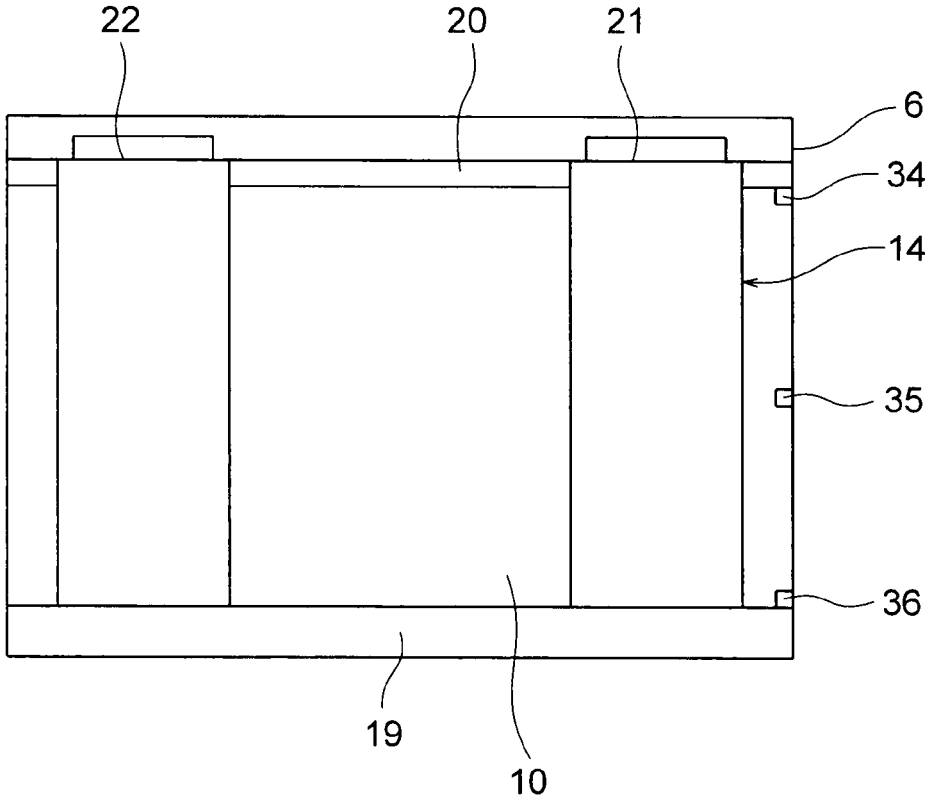
FIG. 23 is a front elevation of a car door apparatus from FIG. 22 viewed from a side near a landing.

Next, FIG. 22 is a horizontal cross section of an elevator sliding door apparatus according to Embodiment 8 of the present invention, and FIG. 23 is a front elevation of a car door apparatus from FIG. 22 viewed from a side near a landing. Embodiment 8 is an example in which the light emitter 32 from Embodiment 1 has been omitted. Cameras 34 through 36 capture images through a space between a car entrance 10 and landing entrances 12 of structures that are present at a far end of that space. Examples of structures of which images are captured include hoistway walls, hoisting machinery, etc. Images of structures of this kind can be captured by the cameras 34 through 36 by illuminating them with lighting apparatuses inside the hoistway 1, or by light from outside the hoistway 1.

Even if the light emitter 32 is omitted in this manner, obstructions that would actually be caught in the doors 21, 22, 28, and 29 can still be detected more reliably because the first through third cameras 34 through 36 are disposed beside the space between the car entrance 10 and the landing entrances 12.

Embodiment 9

Figure 24:
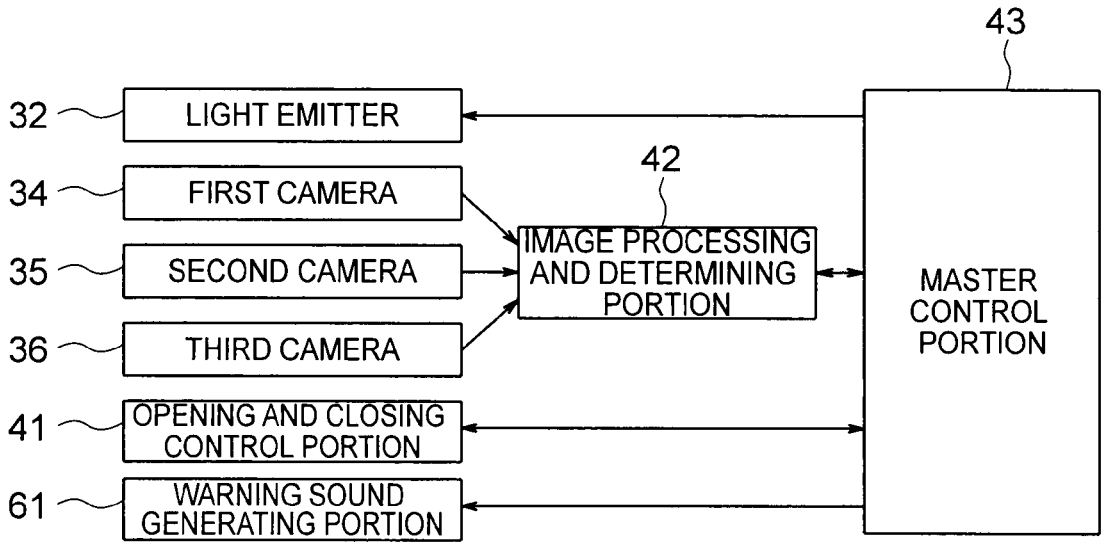
FIG. 24 is an outline block diagram that shows a control circuit of an elevator sliding door apparatus according to Embodiment 9 of the present invention.

Next, FIG. 24 is an outline block diagram that shows a control circuit of an elevator sliding door apparatus according to Embodiment 9 of the present invention. In the figure, a warning sound generating portion 61 that generates a warning sound in a vicinity of a car entrance 10 and landing entrances 12 is connected to a master control portion 43. The warning sound may be a noise such as a buzzer or a chime, etc., or it may also be a voice such as an announcement, etc. The master control portion 43 generates the warning sound using the warning sound generating portion 61 if an obstruction is detected by an image processing and determining portion 42 during door closing. The rest of the configuration is similar to that of Embodiment 1.

Figure 25:
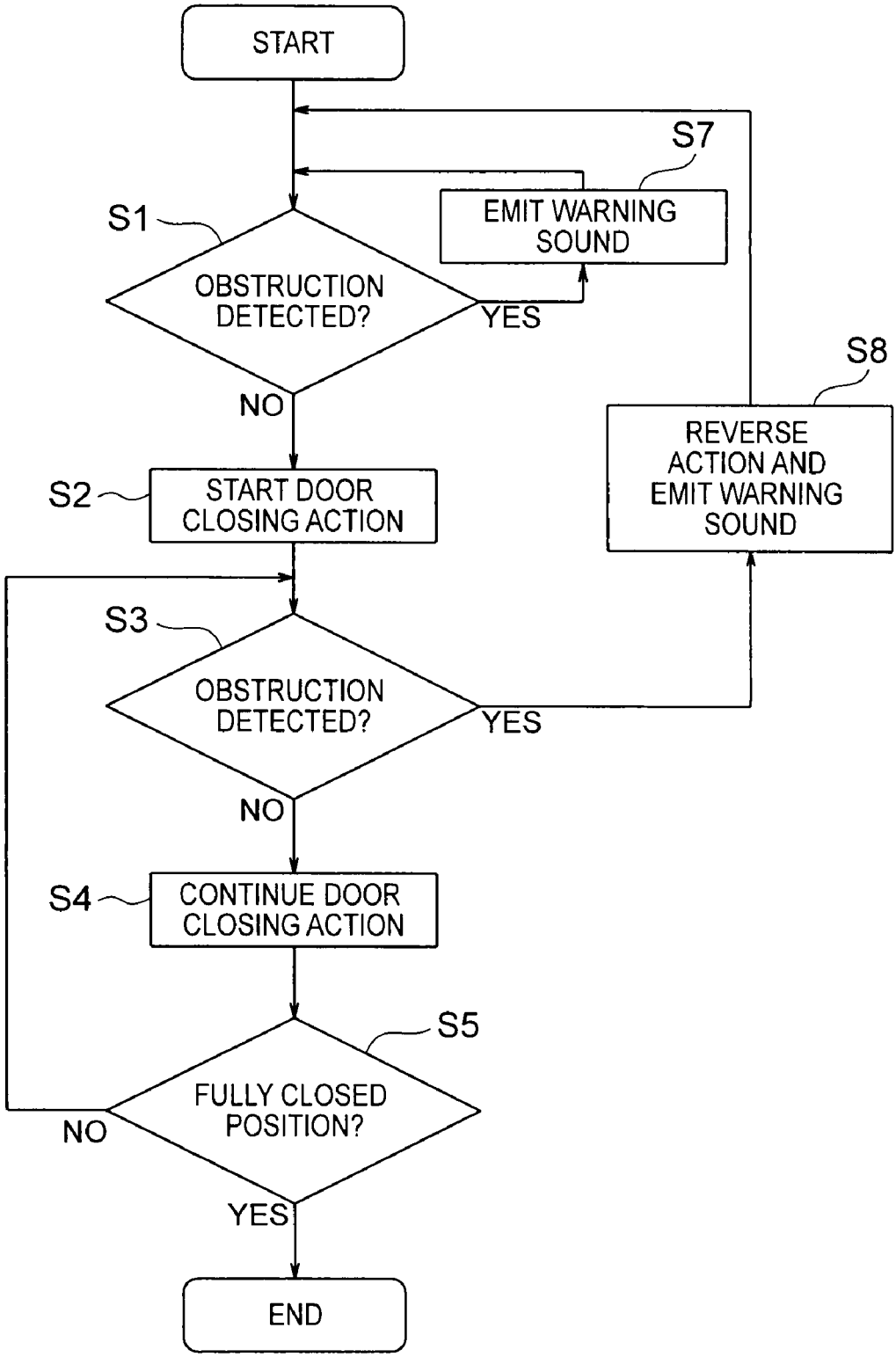
FIG. 25 is a flowchart that shows action of a master control portion from FIG. 24 during door closing.

FIG. 25 is a flowchart that shows action of the master control portion 43 from FIG. 24 during door closing. When a predetermined time interval has elapsed after door opening, the master control portion 43 checks whether an obstruction is present in the monitored regions (Step S1). If no obstruction is present, start the door closing action (Step S2). If an obstruction is present, generate the warning sound using the warning sound generating portion 61 (Step S7), hold until the obstruction is removed, and start the door closing action after the obstruction has been removed.

After starting the door closing action, check whether an obstruction is present in the monitored regions (Step S3), continue the door closing action if no obstruction is present (Step S4), and check whether the car doors 21 and 22 and the landing doors 28 and 29 have reached fully closed positions (Step S5). In other words, during the door closing action, the presence or absence of an obstruction is repeatedly checked for until the doors reach a fully closed state.

If an obstruction is detected during the door closing action, reverse and open the car doors 21 and 22 and the landing doors 28 and 29, and generate the warning sound using the warning sound generating portion 61 (Step S8), and return to the first action. The action in FIG. 24 terminates when the doors reach the fully closed state without an obstruction being detected.

In a sliding door apparatus 13 of this kind, because a warning sound is generated if an obstruction is detected, passengers can be informed aurally that an obstruction that constitutes a hindrance to the door closing action has been detected.

Embodiment 10

Next, Embodiment 10 of the present invention will be explained. Configuration of a sliding door apparatus 13 according to Embodiment 10 is similar to that of Embodiment 1. In Embodiment 10, the master control portion 43 performs a running check (failure detection) on the light emitters 32 and the cameras 34 through 36 when the doors are in the fully closed state.

Figure 6:
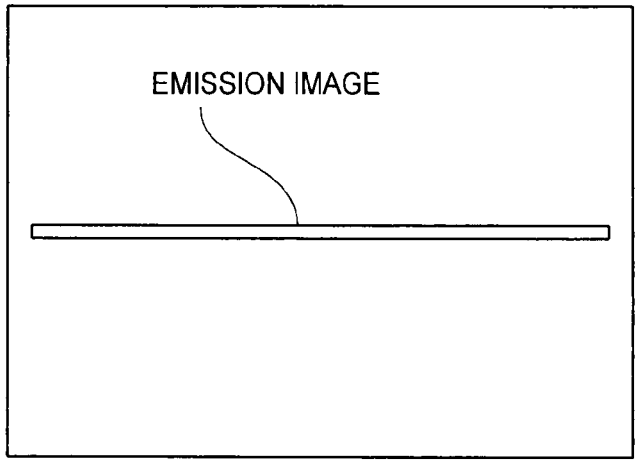
FIG. 6 is an explanatory diagram that shows a differential image that is obtained by an image processing and determining portion from FIG. 5 when an obstruction is not present in a monitored region.

Specifically, the master control portion 43 performs an action that is similar to the obstruction detecting action during door closing when the doors are in the fully closed state. Here, if the light emitters 32 and the cameras 34 through 36 are functioning normally, a continuous light-emitting surface image such as that shown in FIG. 6 is obtained. In contrast to that, if light-emitting surface images such as those shown in FIG. 7 or FIG. 8 are obtained, for example, it can be considered that a portion of the light emitter 32 has failed and can no longer emit light, or images can no longer be captured of a portion of the light-emitting surface image due to failure of the cameras 34 through 36. If the whole of the light-emitting surface image disappears, it can also be considered that the light emitter 32 or the cameras 34 through 36 have failed.

Because of this, if a dark portion that is greater than or equal to a predetermined length is present on the light-emitting surface image or the whole of the light-emitting surface image has disappeared in the running check of the light emitter 32 and the cameras 34 through 36, the master control portion 43 determines that a failure has occurred in at least one of the light emitter 32 or the cameras 34 through 36.

If a failure such as that described above is detected, the opening and closing control portion 41 changes over to low energy operation in which the door closing action is performed at a lower speed than normal. Thus, even if false negative detection of an obstruction occurs due to the failure, mechanical shock from a collision between the doors 21, 22, 28, and 29 and the obstruction can be reduced.

Embodiment 11

Next, Embodiment 11 of the present invention will be explained. Configuration of a sliding door apparatus 13 according to Embodiment 11 is similar to that of Embodiment 1. In Embodiment 11, visible light is used for the detecting beam 33 that is emitted from the light emitter 32. The master control portion 43 changes an emission pattern from the light emitter 32 if an obstruction is detected by an image processing and determining portion 42 during door closing.

For example, when no obstruction has been detected, the light emitter 32 may flash the detecting beam 33 for a predetermined period T (0.1 sec, for example). In contrast to that, when an obstruction is detected, the light emitter 32 may flash the detecting beam 33 for a period that is longer than period T (3T or 4T, for example). The rest of the configuration is similar to that of Embodiment 1.

Figure 26:
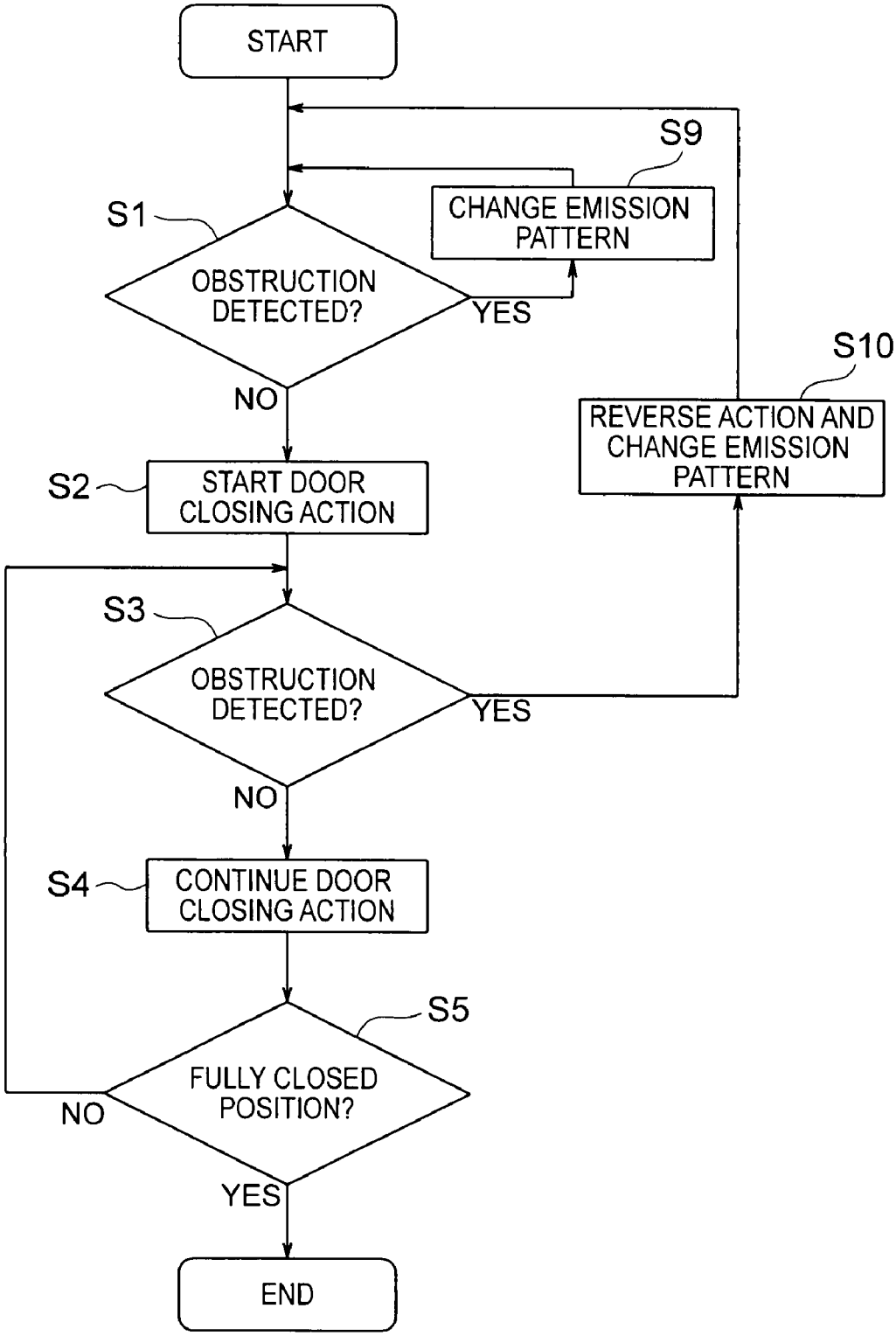
FIG. 26 is a flowchart that shows action of a master control portion according to Embodiment 11 of the present invention during door closing.

FIG. 26 is a flowchart that shows action of the master control portion 43 according to Embodiment 11 of the present invention during door closing. When a predetermined time interval has elapsed after door opening, the master control portion 43 checks whether an obstruction is present in the monitored regions (Step S1). If no obstruction is present, start the door closing action (Step S2). If an obstruction is present, change the emission pattern from the light emitter 32 until a predetermined amount of time elapses (Step S9), and perform the obstruction detecting action again.

After starting the door closing action, check whether an obstruction is present in the monitored regions (Step S3), continue the door closing action if no obstruction is present (Step S4), and check whether the car doors 21 and 22 and the landing doors 28 and 29 have reached fully closed positions (Step S5). In other words, during the door closing action, the presence or absence of an obstruction is repeatedly checked for until the doors reach a fully closed state.

If an obstruction is detected during the door closing action, reverse and open the car doors 21 and 22 and the landing doors 28 and 29, and change the emission pattern from the light emitter 32 (Step S10), and return to the first action. The changed emission pattern continues until the doors reach a fully open state. The action in FIG. 26 terminates when the doors reach the fully closed state without an obstruction being detected.

In a sliding door apparatus 13 of this kind, because the emission pattern from the light emitter 32 is changed if an obstruction is detected, passengers can be informed visually that an obstruction that constitutes a hindrance to the door closing action has been detected.

Moreover, in the above example, the flashing period of the detecting beam 33 is made longer during detection of an obstruction, but the flashing period may also be shortened instead. However, it is preferable to make the flashing period longer because if the flashing period during non-detection of an obstruction is comparatively short, it will be difficult for the passengers to notice if the flashing period is then made even shorter.

In the above example, a change in the flashing period was given as an example of the change in the emission pattern, but the whole of the light-emitting surface 32*a* may also be made to emit light during non-detection of an obstruction, and a portion of the light-emitting surface 32*a* made to emit light during detection of an obstruction, for example.

In addition, emission intensity of the detecting beam 33 may also changed between non-detection and detection of an obstruction. For example, the emission intensity of the detecting beam 33 may also be increased if an obstruction is detected.

Color of the detecting beam 33 may also changed between non-detection and detection of an obstruction.

Embodiment 12

Figure 27:
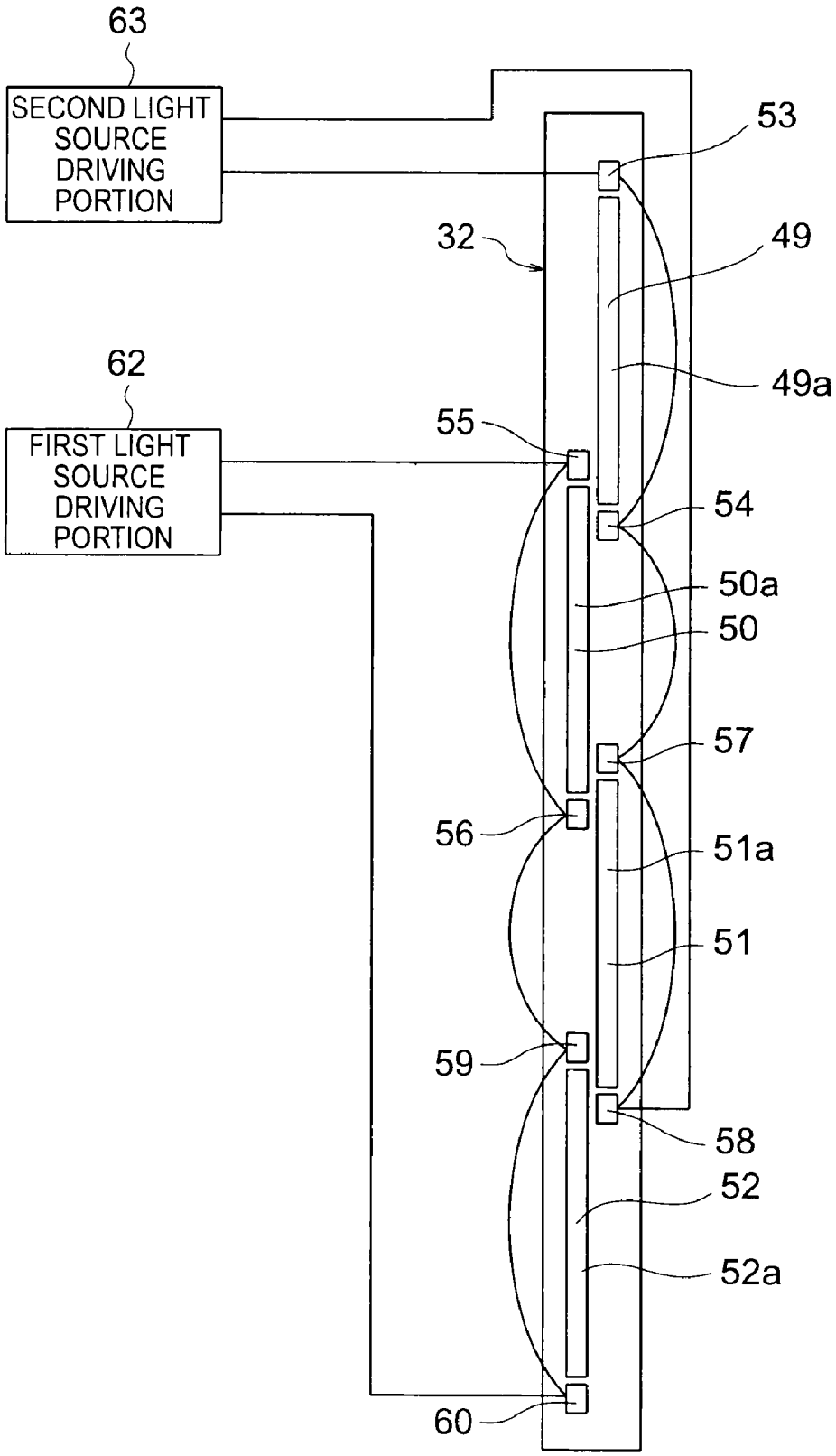
FIG. 27 is a front elevation that shows a light emitter of a sliding door apparatus according to Embodiment 12 of the present invention.

Next, FIG. 27 is a front elevation that shows a light emitter of a sliding door apparatus according to Embodiment 12 of the present invention. In this example, a light-emitting surface of a light emitter 32 is divided into: a plurality of first light-emitting surfaces 50*a* and 52*a* that are driven to switch on by a first light source driving portion 62; and a plurality of second light-emitting surfaces 49*a* and 51*a* that are driven to switch on by a second light source driving portion 63.

Specifically, the first light-emitting surfaces 50*a* and 52*a* are formed on second and fourth transparent light-conducting bodies 50 and 52. The second light-emitting surfaces 49*a* and 51*a* are formed on first and third transparent light-conducting bodies 49 and 51. In other words, the first and second light-emitting surfaces 50*a*, 52*a*, 49*a*, and 51*a* are alternately disposed in a vertical direction of the light emitter 32.

In order to arrange and configure first light-emitting surfaces 50*a* and 52*a* and second light-emitting surfaces 49*a* and 51*a* of this kind, a second upper portion light source 55, a second lower portion light source 56, a fourth upper portion light source 59, and a fourth lower portion light source 60 are connected to the first light source driving portion 62. A first upper portion light source 53, a first lower portion light source 54, a third upper portion light source 57, and a third lower portion light source 58 are connected to the second light source driving portion 63.

In other words, light sources 55, 56, 59, and 60 that correspond to the transparent light-conducting bodies 50 and 52 that are odd numbered ordinal numbers from the bottom and light sources 53, 54, 57, and 58 that correspond to the transparent light-conducting bodies 49 and 51 that are even numbered ordinal numbers from the bottom are wired independently from each other, and are driven to switch on independently from each other by the first and second light source driving portions 62 and 63. The rest of the configuration is similar to that of Embodiment 7.

In a sliding door apparatus 13 such as that described above, even if a failure occurs in a portion of the light sources 53 through 60, power supply cables, or power supply circuitry, the obstruction detecting action can continue to be executed because the light emitter will not cease to emit light completely.

Moreover, in the above example, the first light-emitting surfaces 50*a* and 52*a* and the second light-emitting surfaces 49*a* and 51*a* are disposed alternately in the vertical direction of the light emitter 32 but are not limited to that arrangement, and may also be disposed so as to be divided into an upper portion and a lower portion, for example.

In the above example, the light-emitting surface 49*a*, 50*a*, 51*a*, and 52*a* were divided into two groups, but they may also be divide into three or more groups and be driven to switch on by respective independent light source driving portions.

Embodiment 13

Figure 28:
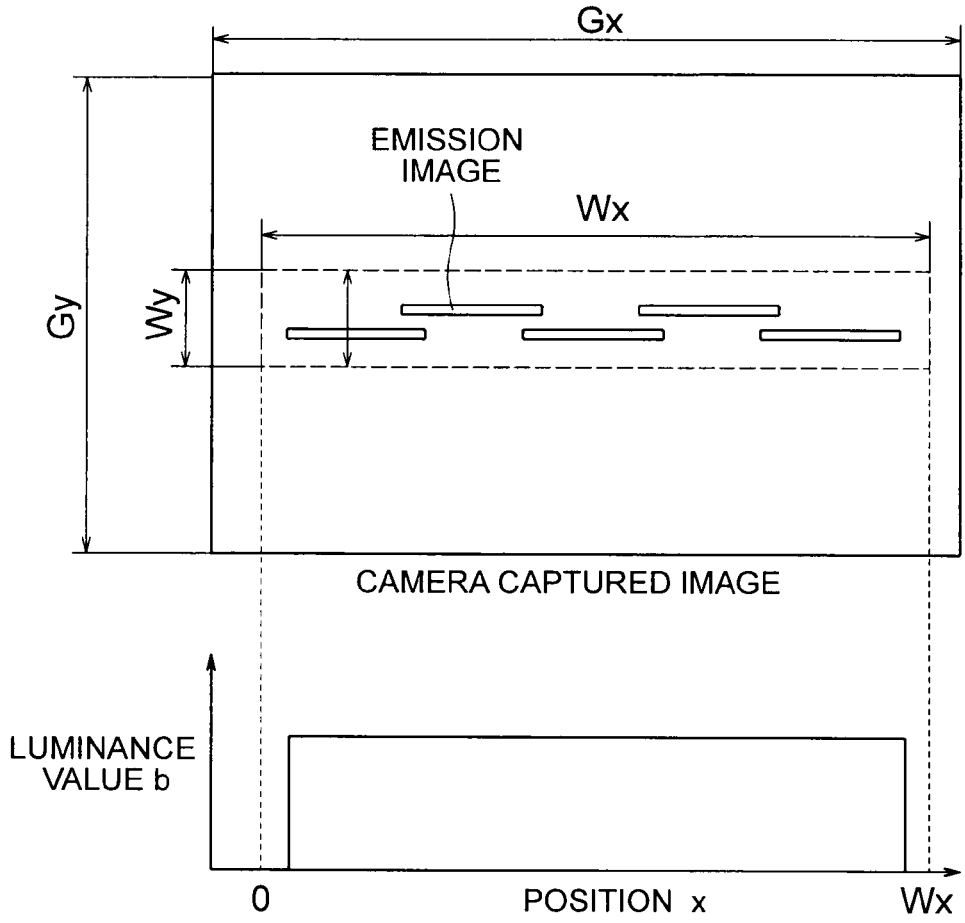
FIG. 28 is an explanatory graph that shows a relationship between a camera captured image and luminance distribution according to Embodiment 13 of the present invention.

Next, FIG. 28 is an explanatory graph that shows a relationship between a camera captured image and luminance distribution according to Embodiment 13 of the present invention. In this example, a light emitter 32 such as that shown in Embodiment 7 or 12 is used. The size of two-dimensional image data that is obtained by the cameras 34 through 36 is Gx by Gy. Moreover, a longitudinal direction (a vertical direction) of the light emitter 32 is the x direction, and a direction that is perpendicular to the x direction is the y direction.

In the image processing and determining portion 42, a differential image is found for image data in a region of a portion that includes the light-emitting surface image (Wx by Wy: Wx<Gx, Wy<Gy). Then, an x-axial distribution of luminance values b(x) is found from the differential image of Wx by Wy using a predetermined calculation. For example, a sum of luminance of all pixels that are lined up in the y direction is found for every position x. An average of luminance of all pixels that are lined up in the y direction may also be found for every position x. In addition, a maximum value of luminance of all pixels that are lined up in the y direction may also be found for every position x. Moving average values of N pixels (N<Wy) in the y direction (average values of N consecutive pixels) for every position x may also be found, and a maximum value of these moving average values found.

Figure 29:
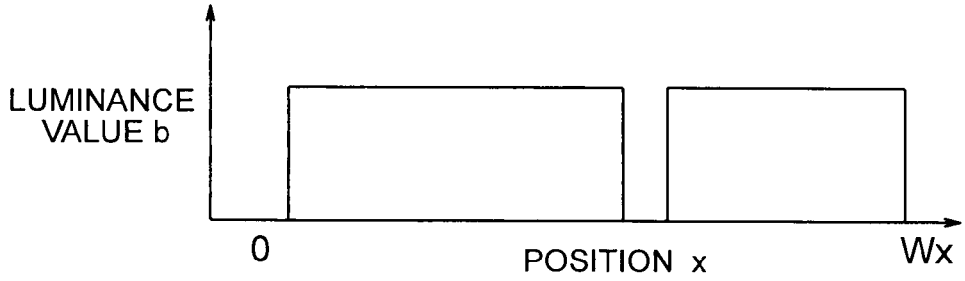
FIG. 29 is a graph that shows an example of luminance distribution when an obstruction is present.

The distribution of the luminance values b(x) that are found in this manner are continuous in the x direction if there is no obstruction, as shown in FIG. 28. In contrast to that, the distribution of the luminance values b(x) is discontinuous when an obstruction is present, as shown in FIG. 29, for example. Consequently, the image processing and determining portion 42 determines that an obstruction is present if at least a portion of the distribution of the luminance values b(x) is less than or equal to a predetermined value.

A luminance difference distribution may also be found by finding distributions of the luminance values b(x) for two sets of image data that are obtained at a predetermined time interval, and taking the difference between the two distributions of luminance values b(x). If there is no moving object, the absolute values of the luminance difference distribution will be small values overall because the distribution of the luminance values b(x) will not change. In contrast to that, if there is a moving object, the absolute values of the luminance difference distribution will be large values in at least a portion since the distribution of the luminance values b(x) will change.

Consequently, in that case, the image processing and determining portion 42 determines that an obstruction is present if the absolute values are greater than or equal to a predetermined value in at least a portion of the luminance difference distribution that is found from the two sets of image data that are obtained at the predetermined time interval.

By using cameras 34 through 36 that obtain two-dimensional image data as imaging means in this manner, precision in positioning the cameras 34 through 36 relative to the light emitter 32 can be lowered, enabling time spent on installation to be reduced. Costs can also be reduced by making use of commercially available imaging devices.

Because image data in a region of a portion that includes the light-emitting surface image are clipped and processed from the two-dimensional image data that the cameras 34 through 36 obtain, the size of the data that is processed is reduced, enabling processing speed to be increased.

In addition, because a vertical luminance distribution is found from the two-dimensional image data by a predetermined calculation, and the presence or absence of an obstruction is determined based on the luminance distribution, processing speed can be increased further, since two-dimensional image data are converted to one-dimensional luminance data. By converting to the one-dimensional luminance distribution, the presence or absence of an obstruction can be determined directly therefrom even if the light-emitting surface is divided plurally.

By determining the presence or absence of an obstruction from absolute values of a luminance difference distribution that is found from two sets of image data that are obtained at a predetermined time interval, litter that has adhered the light emitter 32 or the cameras 34 through 36 can be prevented from being mistakenly determined as an obstruction, enabling detecting precision to be improved.

Embodiment 14

Figure 30:
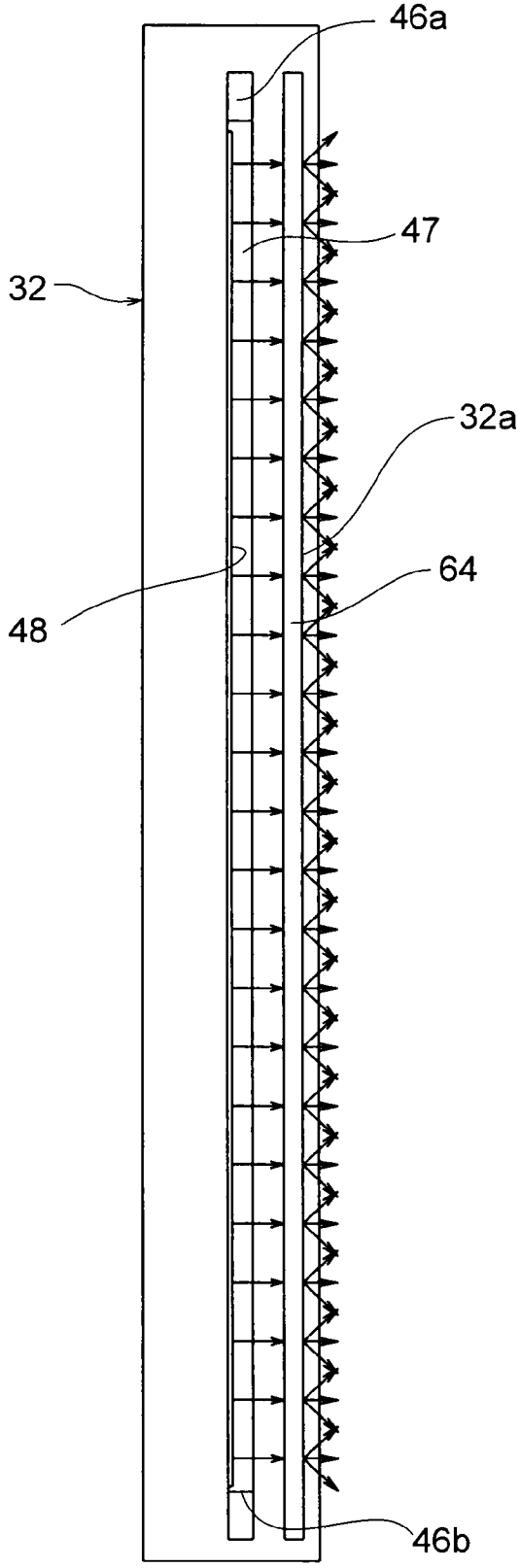
FIG. 30 is a cross section of a light emitter of a sliding door apparatus according to Embodiment 14 of the present invention.

Next, FIG. 30 is a cross section of a light emitter of a sliding door apparatus according to Embodiment 14 of the present invention. In a light emitter 32 according to Embodiment 14, a diffusing plate 64 that diffuses light as it passes through is disposed in front of a transparent light-conducting body 47 according to Embodiment 6. That is, the diffusing plate 64 is disposed so as to face a front surface of the transparent light-conducting body 47. Light emitted from the front surface of the transparent light-conducting body 47 is scattered by the diffusing plate 64, and is emitted out from a light emitter 32 from a front surface of the diffusing plate 64, that is, from a light-emitting surface 32*a*. The rest of the configuration is similar to that of Embodiment 6.

By disposing a diffusing plate 64 in front of the transparent light-conducting body 47 in this manner, the captured light-emitting surface image has sufficient brightness irrespective of the height of the cameras 34 through 36, since the light that is emitted from the transparent light-conducting body 47 is scattered uniformly in a vertical direction, enabling detecting precision to be improved.

Embodiment 15

Figure 31:
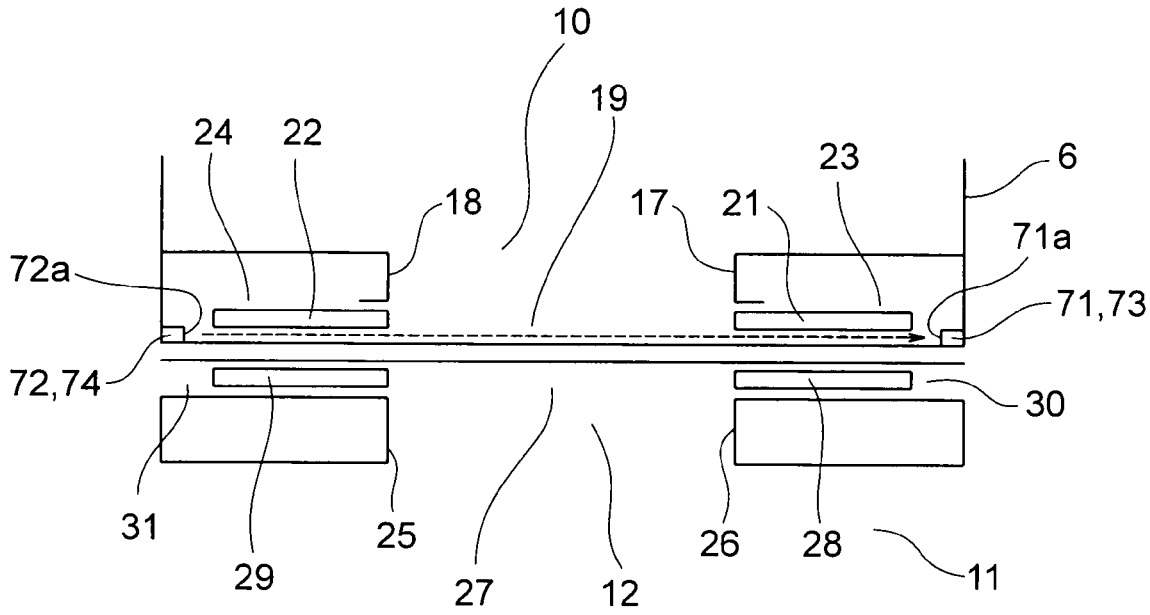
FIG. 31 is a horizontal cross section of an elevator sliding door apparatus according to Embodiment 15 of the present invention.
Figure 32:
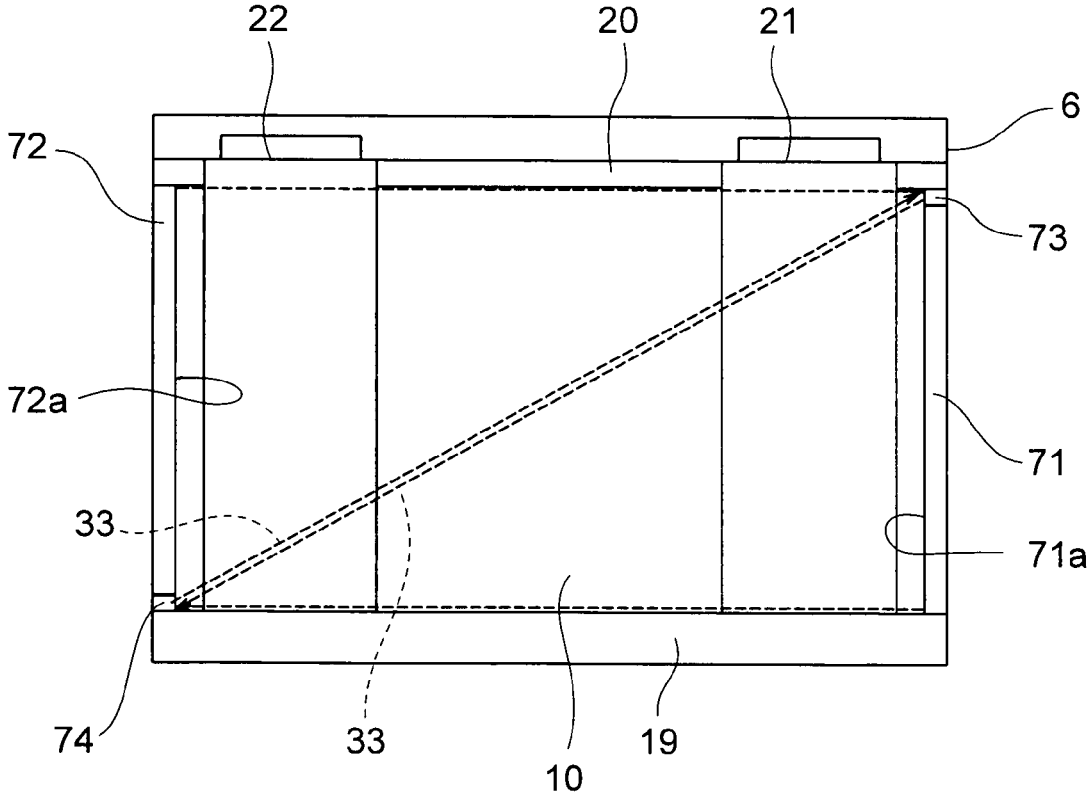
FIG. 32 is a front elevation of a car door apparatus from FIG. 31 viewed from a side near a landing.

Next, FIG. 31 is a horizontal cross section of an elevator sliding door apparatus according to Embodiment 15 of the present invention, and FIG. 32 is a front elevation of a car door apparatus from FIG. 31 viewed from a side near a landing. In the figures, first and second light emitters 71 and 72 are disposed in a vicinity of car door housing portions 23 and 24 of a car 6 (closer to landings than car doors 22). Specifically, the first and second light emitters 71 and 72 are disposed so as to that face each other on opposite sides of a space between a car entrance 10 and landing entrances 12.

The light emitters 71 and 72 aim detecting beams 33 parallel to a closing and opening direction of the car doors 21 and 22 in a space between the car doors 21 and 22 and the landing doors 28 and 29. The light emitters 71 and 72 have vertically long and continuous light-emitting surfaces 71*a* and 72*a*.

Imaging means includes: a first camera 73 that is disposed on an upper portion of the first light emitter 71, and that captures images of the light-emitting surface 72*a* of the second light emitter 72; and a second camera 74 that is disposed on a lower portion of the second light emitter 72, and that captures images of the light-emitting surface 71*a* of the first light emitter 71. The rest of the configuration is similar to that of Embodiment 1.

In a sliding door apparatus 13 of this kind, a detection range that is formed by the light emitters 71 and 72 and the cameras 73 and 74 is an entire surface between the light emitters 71 and 72. Consequently, regions in which detection is not possible are eliminated even when the car doors 21 and 22 and the landing doors 28 and 29 are fully open, enabling reliability to be improved.

Moreover, in the above examples, a sliding door apparatus that opens to two sides has been explained, but the present invention can also be applied to doors that open to one side, and the car doors and the landing doors are not limited to a particular number of leaves.

In the above examples, a drum-wound elevator apparatus has been shown, but the present invention can of course also be applied to traction elevator apparatuses that use a counterweight.

In addition, in the above examples, the present invention has been applied to an elevator, but the present invention can also be applied to sliding door apparatuses other than elevators such as double-door door apparatuses that are disposed in buildings, or door apparatuses that include train doors and platform doors, etc., for example.

The invention claimed is:

1. A sliding door apparatus comprising:

a first door that opens and closes a first entrance by being slid horizontally;

a second door that opens and closes a second entrance that faces the first entrance by being slid horizontally together with the first door;

imaging means that is disposed beside a space between the first entrance and the second entrance, and that captures images across the space a light emitter that has a vertically long light-emitting surface that is disposed so as to face the imaging means across the space, the imaging means capturing images of the light-emitting surface; and a control apparatus that has an image processing and determining portion that determines presence or absence of an obstruction inside the space based on image data from the imaging means, and that controls opening and closing of the first and second doors depending on presence or absence of an obstruction, the image processing and determining portion using a reference length of an image of the light-emitting surface that corresponds to a position of the first door, and the image processing and determining portion determines that an obstruction is present if an image of the light-emitting surface is discontinuous, if a length of an image of the light-emitting surface becomes shorter, or if an image of the light-emitting surface disappears.

2. The sliding door apparatus according to claim 1, wherein the imaging means includes a plurality of cameras that are disposed at differing heights.

3. The sliding door apparatus according to claim 1, wherein the image processing and determining portion determines presence or absence of an obstruction based on a differential image between image data when the light emitter is switched off and image data when the light emitter is switched on.

4. The sliding door apparatus according to claim 1, wherein at least one of the imaging means or the light emitter is mounted to the first door.

5. The sliding door apparatus according to claim 1, wherein the light emitter emits visible light.

6. The sliding door apparatus according to claim 1, wherein the light emitter has:

a transparent light-conducting body that forms the light-emitting surface and that constitutes a diffusing surface in which a surface that faces the light-emitting surface diffuses light; and a light source that shines light into the transparent light-conducting body.

7. The sliding door apparatus according to claim 1, wherein the light-emitting surface is divided plurally, and the light-emitting surfaces that are adjacent vertically are disposed so as to be offset in a width direction of the light emitter and overlap partially in a vertical direction.

8. The sliding door apparatus according to claim 1, wherein the control apparatus makes the light emitter emit light when doors are in a fully closed state, and determines that a failure has occurred if a dark portion that is greater than or equal to a predetermined length is present on an image of the light-emitting surface, or if an image of the light-emitting surface disappears completely.

9. The sliding door apparatus according to claim 4, wherein the light emitter and the imaging means are disposed such that a position of an end portion of the light-emitting surface that the imaging means captures an image of changes together with movement of the first door, and the control apparatus finds a position of the first door based on a position of an end portion of an image of the light-emitting surface.

10. The sliding door apparatus according to claim 8, wherein the control apparatus performs a door closing action of the first and second doors at a lower speed than normal if a failure is detected.

11. The sliding door apparatus according to claim 1, wherein the light emitter has a plurality of light-emitting surfaces that are each driven to switch on by an independent light source driving portion.

12. The sliding door apparatus according to claim 1, wherein the image processing and determining portion finds a vertical luminance distribution by a predetermined calculation from two-dimensional image data that is obtained by the imaging means, and determines presence or absence of an obstruction based on the luminance distribution.

13. The sliding door apparatus according to claim 1, wherein the image processing and determining portion finds a vertical luminance distribution by a predetermined calculation from two-dimensional image data that is obtained by the imaging means, takes a difference between two luminance distributions that are obtained at a predetermined time interval and finds a luminance difference distribution, and determines presence or absence of an obstruction based on the luminance difference distribution.

14. The sliding door apparatus according to claim 1, wherein the light emitter has:

a transparent light-conducting body that constitutes a diffusing surface in which a back surface diffuses light;

a light source that shines light into the transparent light-conducting body; and a diffusing plate that is disposed so as to face a front surface of the transparent light-conducting body, and that diffuses light.

15. The sliding door apparatus according to claim 1, further comprising first and second light emitters that are disposed so as to face each other across the space, and that each have a vertically long light-emitting surface, the imaging means including:

a first camera that is disposed on an upper portion of the first light emitter, and that captures images of the light-emitting surface of the second light emitter; and a second camera that is disposed on a lower portion of the second light emitter, and that captures images of the light-emitting surface of the first light emitter.

16. A sliding door apparatus comprising:

a first door that opens and closes a first entrance by being slid horizontally;

a second door that opens and closes a second entrance that faces the first entrance by being slid horizontally together with the first door;

imaging means that is disposed beside a space between the first entrance and the second entrance, and that captures images across the space;

a light emitter that has a vertically long light-emitting surface that is disposed so as to face the imaging means across the space, the imaging means capturing images of the light-emitting surface; and a control apparatus that has an image processing and determining portion that determines presence or absence of an obstruction inside the space based on image data from the imaging means, and that controls opening and closing of the first and second doors depending on presence or absence of an obstruction, the control apparatus changing an emission pattern from the light emitter if an obstruction is detected during door closing.

17. The sliding door apparatus according to claim 16, wherein the control apparatus changes a color of the light emitted from the light emitter if an obstruction is detected during door closing.

18. An elevator comprising:

a car that has a car entrance, and that is raised and lowered inside a hoistway;

a car door that is disposed on the car, and that opens and closes the car entrance by being slid horizontally;

a landing door that is disposed on a landing, and that opens and closes a landing entrance by being slid horizontally together with the car door;

imaging means that is disposed on the car beside a space between the car entrance and the landing entrance, and that captures images across the space;

a light emitter that has a vertically long light-emitting surface that is disposed so as to face the imaging means across the space, the imaging means capturing images of the light-emitting surface; and a control apparatus that has an image processing and determining portion that determines presence or absence of an obstruction inside the space based on image data from the imaging means, and that controls opening and closing of the car door and the landing door depending on presence or absence of an obstruction, the image processing and determining portion using a reference length of an image of the light-emitting surface that corresponds to a position of the car door, and the image processing and determining portion determines that an obstruction is present if an image of the light-emitting surface is discontinuous, if a length of an image of the light-emitting surface becomes shorter, or if an image of the light-emitting surface disappears.

19. An elevator comprising:

a car that has a car entrance, and that is raised and lowered inside a hoistway;

a car door that is disposed on the car, and that opens and closes the car entrance by being slid horizontally, the car door including a first door and a second door on opposite lateral sides of the car;

a landing door that is disposed on a landing, and that opens and closes a landing entrance by being slid horizontally together with the car door;

an imaging device disposed on the car beside a space between the car entrance and the landing entrance, and that captures images across the space, the imaging device including a light emitter disposed on the first door and a camera disposed on the second door; and a control apparatus that has an image processing and determining portion that determines presence or absence of an obstruction inside the space based on image data from the imaging device, and that controls opening and closing of the car door and the landing door depending on presence or absence of an obstruction, the control apparatus determining a position of the first door and the second door while the first door and the second door are closing to generate a reference length of a light emitting surface of the light emitter to determine if the obstruction is present.

* * * * *